US010280695B2

(12) United States Patent
Rodrigue et al.

(10) Patent No.: US 10,280,695 B2
(45) Date of Patent: May 7, 2019

(54) CENTRALIZER

(71) Applicant: Weatherford Technology Holdings, LLC, Houston, TX (US)

(72) Inventors: Maxime R. Rodrigue, Vacherie, LA (US); Philip E. Dufrene, Houma, LA (US); Beau H. Martin, Raceland, LA (US); Christian Kiess, Hannover (DE); Martin Helms, Burgdorf (DE); Adam Kyzar, Houma, LA (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 425 days.

(21) Appl. No.: 14/741,235

(22) Filed: Jun. 16, 2015

(65) Prior Publication Data

US 2015/0376960 A1 Dec. 31, 2015

Related U.S. Application Data

(60) Provisional application No. 62/018,246, filed on Jun. 27, 2014.

(51) Int. Cl.
*E21B 17/10* (2006.01)
*E21B 33/14* (2006.01)

(52) U.S. Cl.
CPC ..... *E21B 17/1078* (2013.01); *E21B 17/1028* (2013.01); *E21B 33/14* (2013.01)

(58) Field of Classification Search
CPC ..... E21B 17/1028; E21B 17/1021; E21B 17/1078; E21B 33/14
See application file for complete search history.

(56) References Cited

U.S. PATENT DOCUMENTS

| | | | | |
|---|---|---|---|---|
| 1,775,376 | A | 9/1930 | Steps et al. | |
| 1,998,833 | A | 4/1935 | Crowell | |
| 2,058,310 | A * | 10/1936 | Hartman | E21B 17/1028 166/241.6 |
| 2,089,553 | A | 8/1937 | Hartman et al. | |
| 2,845,128 | A | 7/1958 | Clark et al. | |
| 3,062,297 | A * | 11/1962 | Tyrrell, Jr. | E21B 17/1028 166/241.7 |
| 4,077,470 | A * | 3/1978 | Dane | E21B 17/1028 166/241.7 |

(Continued)

FOREIGN PATENT DOCUMENTS

DE G8903038-9 6/1989

OTHER PUBLICATIONS

EPO Search Report dated Feb. 19, 2016, for EPO Patent Application No. 15173195.7.

(Continued)

*Primary Examiner* — Jennifer H Gay
(74) *Attorney, Agent, or Firm* — Patterson & Sheridan, L.L.P.

(57) ABSTRACT

A centralizer sub for cementing a tubular string in a wellbore includes: a tubular body; a centralizer disposed along an outer surface of the body and having a pair of collars and a plurality of bow springs connecting the collars; and a joint longitudinally linking the centralizer to the body. The joint has: a groove formed in and around the body outer surface, and a plurality of protrusions formed integrally with or mounted to one of the collars and extending into the groove.

13 Claims, 15 Drawing Sheets

(56) References Cited

U.S. PATENT DOCUMENTS 4,269,269 A * 5/1981 Wilson ..... E21B 17/1028 166/241.7
4,506,219 A 3/1985 Lee
4,580,632 A 4/1986 Reardon
4,669,541 A 6/1987 Bissonnette
5,033,459 A 7/1991 Champeaux et al.
5,238,062 A 8/1993 Reinholdt
5,575,333 A 11/1996 Lirette et al.
6,209,638 B1 4/2001 Mikolajczyk
6,453,998 B1 9/2002 Reeve
6,484,803 B1 11/2002 Gremillion
7,140,432 B2 11/2006 Gremillion
7,156,171 B2 1/2007 Gremillion
7,182,131 B2 2/2007 Gremillion
8,245,777 B2 8/2012 Garner
8,505,624 B2 8/2013 Levie
D718,342 S * 11/2014 Buytaert ..... D15/21
8,991,487 B2 * 3/2015 Levie ..... E21B 17/1028 166/241.1
2002/0139537 A1 10/2002 Young et al.
2002/0139538 A1 10/2002 Young et al.
2004/0226714 A1 * 11/2004 Rogers ..... E21B 17/1028 166/241.2
2010/0018698 A1 1/2010 Garner
2010/0181079 A1 7/2010 Johnson et al.
2012/0145410 A1 * 6/2012 Levie ..... B29C 45/14598 166/382
2013/0025881 A1 1/2013 Buytaed et al.
2013/0118752 A1 * 5/2013 Hannegan ..... E21B 47/0005 166/336
2013/0248206 A1 9/2013 Jordan et al.
2013/0319689 A1 12/2013 Levie et al.
2013/0319690 A1 12/2013 Levie et al.
2015/0376960 A1 * 12/2015 Rodrigue ..... E21B 33/14 166/285
2016/0186505 A1 * 6/2016 Roger ..... E21B 17/1028 166/241.6
2017/0009536 A1 * 1/2017 Kiess ..... E21B 17/1078

OTHER PUBLICATIONS

Canadian Office Action dated Apr. 4, 2016, for Canadian Patent Application No. 2,894,848.
Canadian Office Action dated Mar. 10, 2017, for Canadian Patent Application No. 2,894,848.
Expand-O-Lizer Sub Info Sheet, Bk Oil Tools B.V., Heemskerk, The Netherlands, One Page.
Australian Patent Examination Report dated Jan. 22, 2016, for Australian Patent Application No. 2015203473.
EPO Examination Report dated Mar. 8, 2017, for European Patent Application No. 15173195.7.
GCC Examination Report dated Jan. 17, 2018, for Patent Application No. GC 2015-29622.
Australian Exam Report in related application AU 2017200428 dated Nov. 16, 2017.
Canadian Office Action dated Jan. 26, 2018, for Canadian Patent Application No. 2,894,848.

* cited by examiner

CENTRALIZER

BACKGROUND OF THE DISCLOSURE

Field of the Disclosure

The present disclosure generally relates to a centralizer.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Centralizers are mounted on the casing string to center the casing string in the wellbore and obtain a uniform thickness cement sheath around the casing string. Each centralizer has blades extending out from the casing wall and contacting the wellbore, thereby holding the casing string off of direct contact with the wellbore wall, and substantially centralizing the casing therein. To accomplish that goal, the centralizer blades typically form a total centralizer diameter roughly the diameter of the wellbore in which the casing string is run.

One type of centralizer is rigid including a solid central tubular body having a plurality of solid blades integral with the central body, the blades extending out to the desired diameter. Another type is a bow spring centralizer, which includes a pair of spaced-apart bands locked into place on the casing; and a number of outwardly bowed, resilient bow spring blades connecting the two bands and spaced around the circumference of the bands. The bow spring centralizers are capable of at least partially collapsing as the casing string is run into the wellbore to pass through any restricted diameter location, such as a piece of equipment having an inner diameter smaller than the at-rest bow spring diameter, then spring back out after passage through the reduced diameter equipment.

SUMMARY OF THE DISCLOSURE

The present disclosure generally relates to a centralizer. In one embodiment, a centralizer sub for cementing a tubular string in a wellbore includes: a tubular body; a centralizer disposed along an outer surface of the body and having a pair of collars and a plurality of bow springs connecting the collars; and one or two joints longitudinally linking the centralizer to the body. Each joint has: a groove formed in and around the body outer surface, and a plurality of protrusions formed integrally with or mounted to one of the collars and extending into the groove.

In another embodiment, a centralizer sub for cementing a tubular string in a wellbore includes: a tubular body; a centralizer disposed along an outer surface of the body and having a pair of collars and a plurality of bow springs connecting the collars; and one or two joints longitudinally linking the centralizer to the body. Each joint has: a groove formed in and around the body outer surface, and a protrusion attached or fastened to one of the collars, extending into the groove, and extending around an inner surface of the one collar.

In another embodiment, a centralizer sub for cementing a tubular string in a wellbore includes: a tubular body; a centralizer disposed along an outer surface of the body and having a pair of collars and a plurality of bow springs connecting the collars; and one or two joints longitudinally linking the centralizer to the body. Each joint has: a groove formed around one of: the body outer surface and one of the collars, and a bead extending into the groove and formed around the other of: the body outer surface and the one collar.

In another embodiment, a centralizer sub for cementing a tubular string in a wellbore includes: a tubular body; a centralizer disposed along an outer surface of the body and having a pair of collars and a plurality of bow springs connecting the collars; and one or two arrestors longitudinally linking and torsionally connecting the centralizer to the body. Each arrestor has: spaces formed between the bow springs, and a set of keys formed around the body outer surface adjacent to one of the collars and extending into the spaces.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
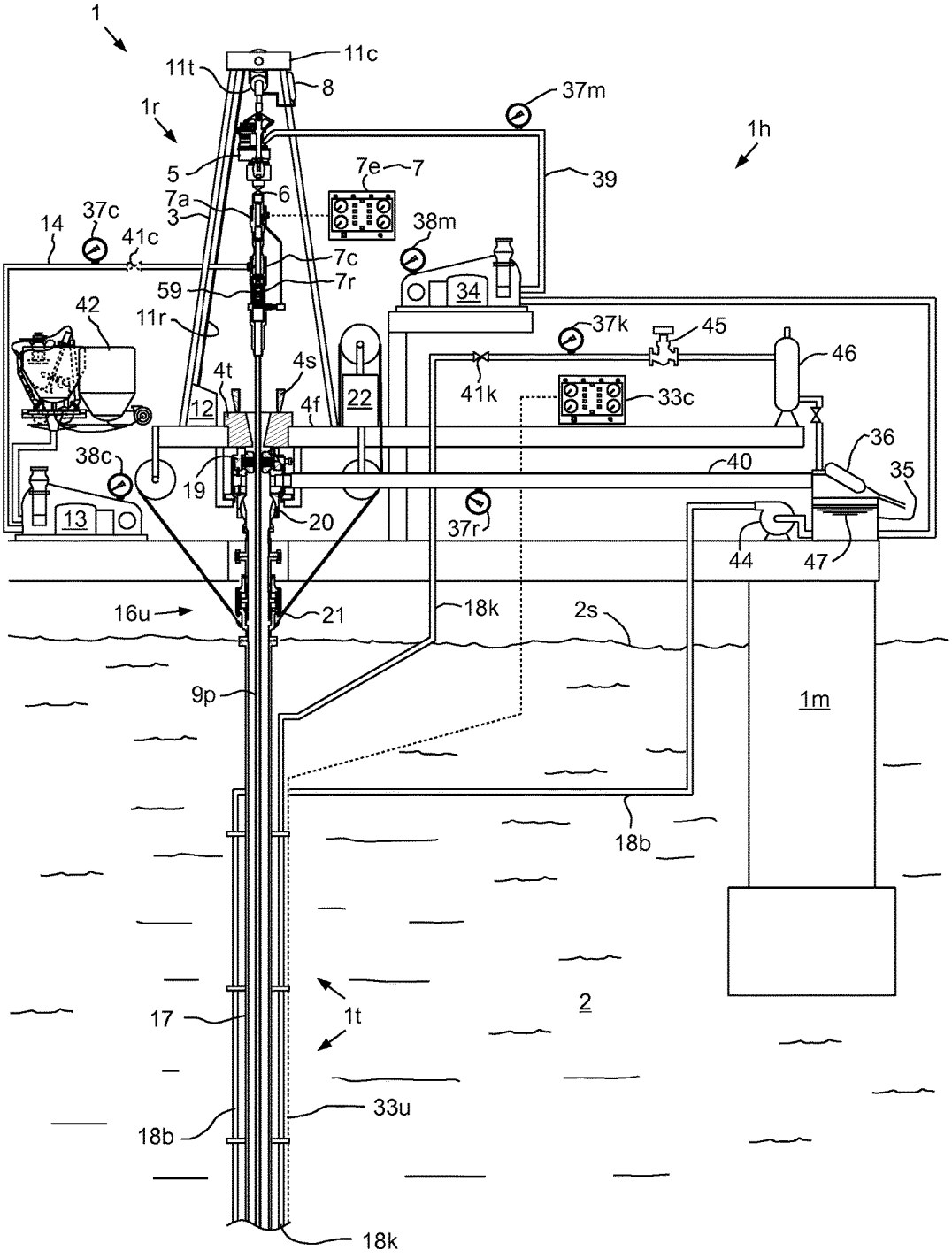
FIGS. 1A-1C illustrate a casing string and a drilling system in a cementing mode for installation thereof, according to one embodiment of this disclosure.
Figure 1B:
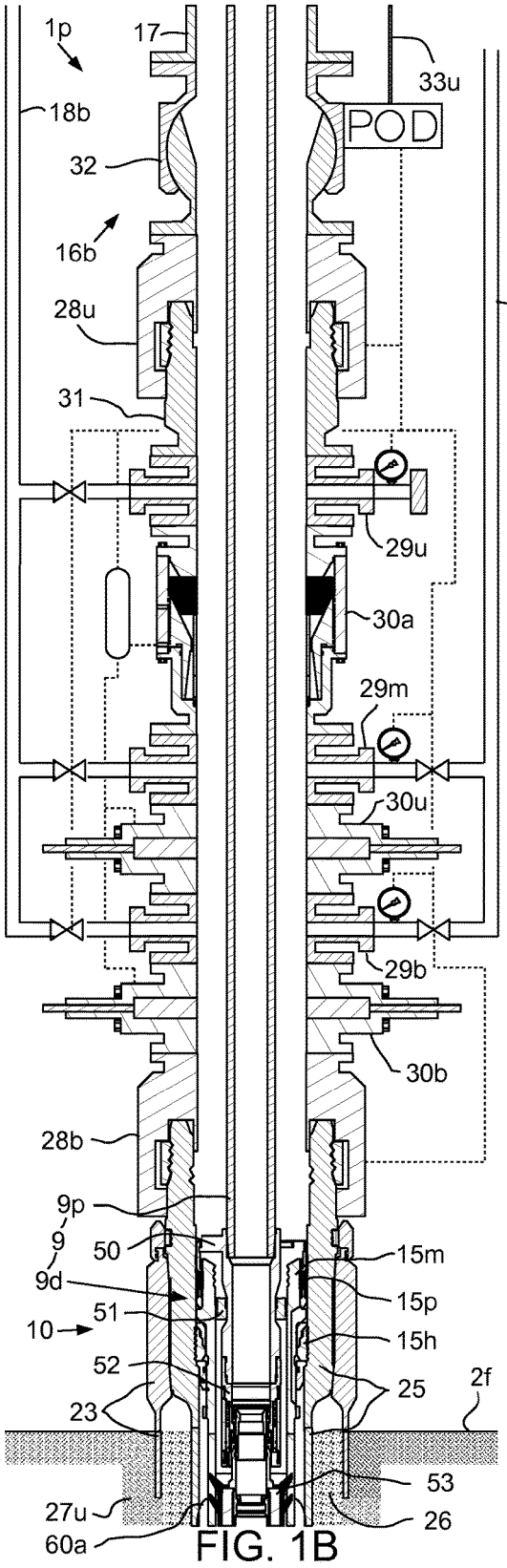
Figure 1C:
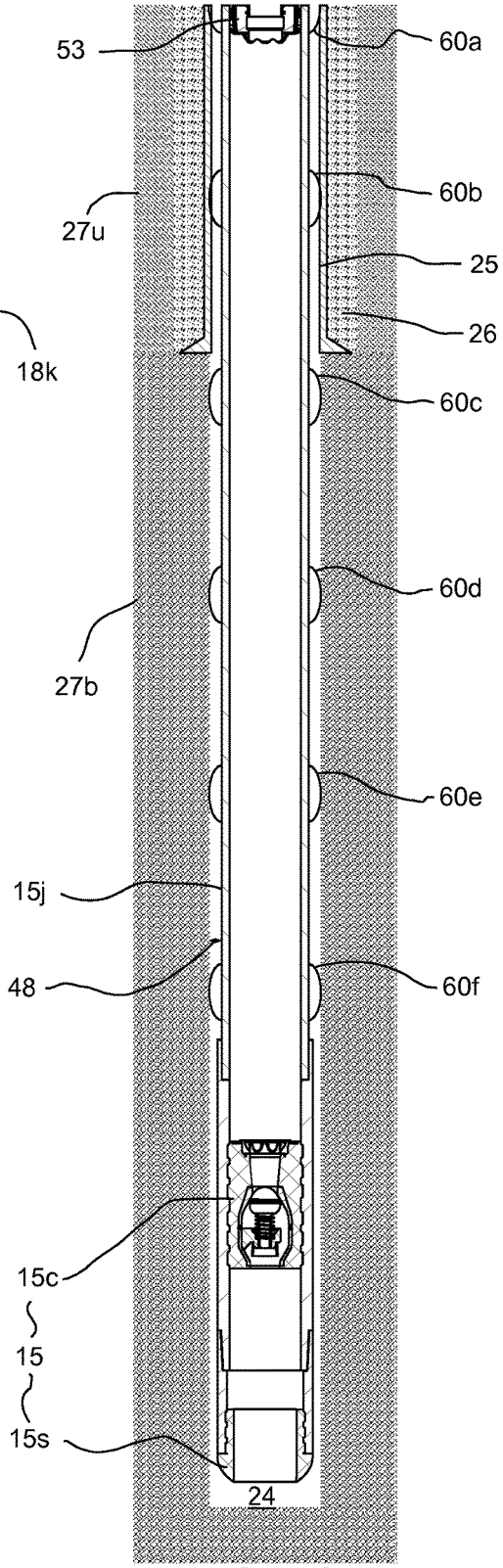

FIGS. 1A-1C illustrate an inner casing string 15 and a drilling system 1 in a cementing mode for installation thereof, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system 1*t*, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline 2*s*. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

Figures 3A, 3B, 3C, 3D:
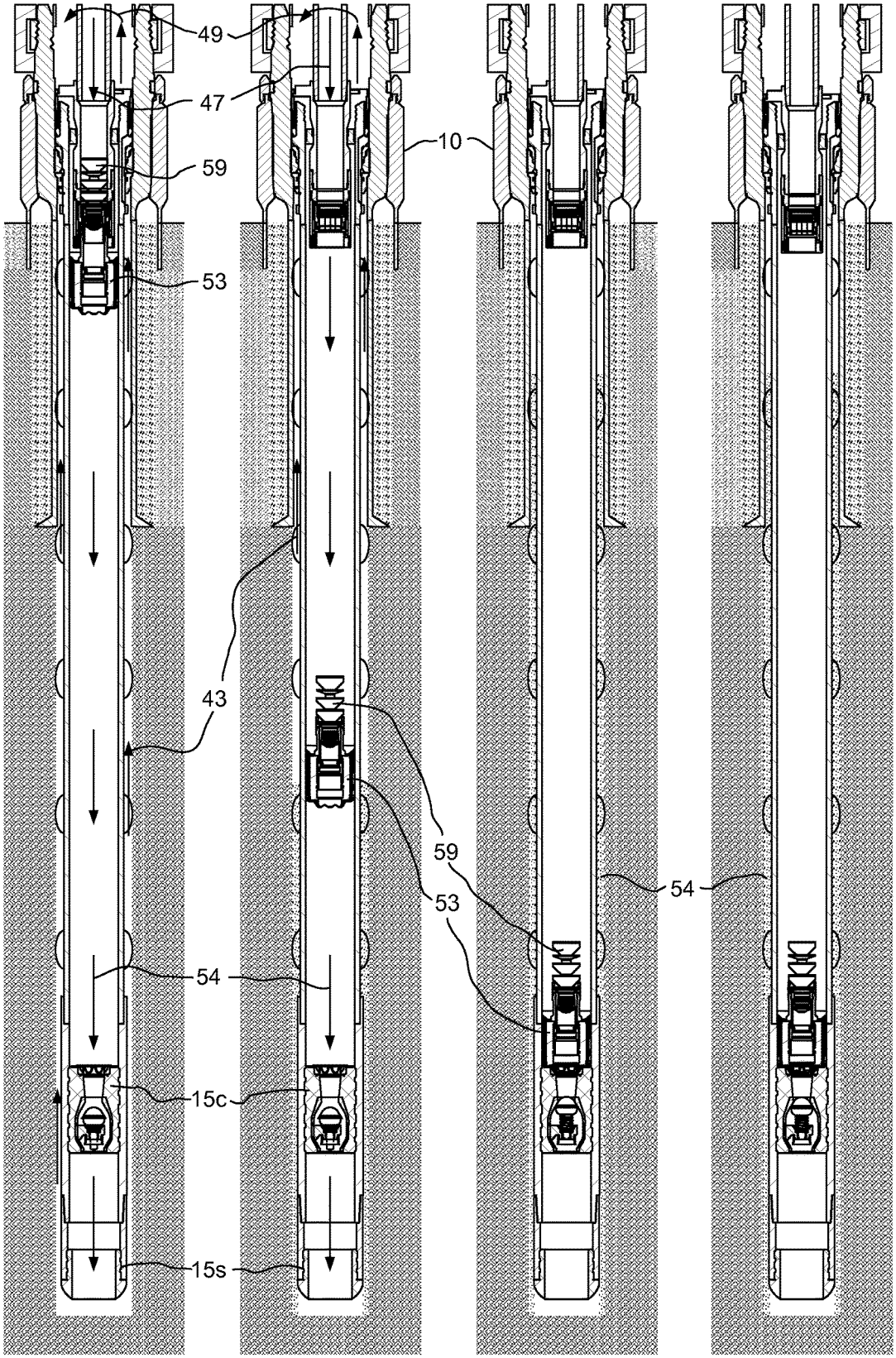
FIGS. 3A-3D illustrate cementing of the casing string.

The drilling rig 1*r* may include a derrick 3, a floor 4*f*, a rotary table 4*t*, a spider 4*s*, a top drive 5, a cementing head 7, and a hoist. The top drive 5 may include a motor for rotating 49 (FIG. 3A) the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The top drive frame may be suspended from the traveling block 11*t* by a drill string compensator 8. The quill may be torsionally driven by the top drive motor and supported from the frame by bearings. The top drive 5 may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3.

The drill string compensator may 8 may alleviate the effects of heave on the workstring 9 when suspended from the top drive 5. The drill string compensator 8 may be active, passive, or a combination system including both an active and passive compensator.

Alternatively, the drill string compensator 8 may be disposed between the crown block 11*c* and the derrick 3. Alternatively, a Kelly and rotary table may be used instead of the top drive 5.

When the drilling system 1 is in a deployment mode (not shown), an upper end of the workstring 9 may be connected to the top drive quill, such as by threaded couplings. The workstring 9 may include a casing deployment assembly (CDA) 9*d* and a work stem, such as joints of drill pipe 9*p* connected together, such as by threaded couplings. An upper end of the CDA 9*d* may be connected a lower end of the drill pipe 9*p*, such as by threaded couplings. The CDA 9*d* may be connected to the inner casing string 15, such as by engagement of a bayonet lug with a mating bayonet profile formed in an upper end of the inner casing string 15.

The fluid transport system 1*t* may include an upper marine riser package (UMRP) 16*u*, a marine riser 17, a booster line 18*b*, and a choke line 18*k*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 19, such as by a flanged connection. The diverter 19 may also be connected to the rig floor 4*f*, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and an outer casing string 25 may be deployed into the wellbore. The outer casing string 25 may include a wellhead housing and joints of casing connected together, such as by threaded couplings. The wellhead housing may land in the conductor housing during deployment of the casing string 25. The outer casing string 25 may be cemented 26 into the wellbore 24. The outer casing string 25 may extend to a depth adjacent a bottom of the upper formation 27*u*. The wellbore 24 may then be extended into the lower formation 27*b* using a drill string (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a control console 33*c* onboard the MODU 1*m* via an umbilical 33*u*. The control pod may include one or more control valves (not shown) in communication with the BOPs 30*a,u,b* for operation thereof. Each control valve may include an electric or hydraulic actuator in communication with the umbilical 33*u*. The umbilical 33*u* may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The control console 33*c* may operate the PCA 1*p* via the umbilical 33*u* and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. An upper end of the booster line 18*b* may be connected to an outlet of a booster pump 44. A lower end of the choke line 18*k* may have prongs connected to respective second branches of the flow crosses 29*m,b*. Shutoff valves may be disposed in respective prongs of the choke line lower end. An upper end of the choke line 18*k* may be connected to an inlet of a mud gas separator (MGS) 46.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33*u* may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical 33*u* may be extended between the MODU 1*m* and the PCA 1*p* independently of the riser 17. Alternatively, the shutoff valve actuators may be electrical or pneumatic. Alternatively, a separate kill line (not shown) may be connected to the branches of the flow crosses 29*m,b* instead of the booster manifold.

The fluid handling system 1*h* may include one or more pumps, such as a cement pump 13, a mud pump 34, and the booster pump 44, a reservoir, such as a tank 35, a solids separator, such as a shale shaker 36, one or more pressure gauges 37*c,k,m,r*, one or more stroke counters 38*c,m*, one or more flow lines, such as cement line 14, mud line 39, and return line 40, one or more shutoff valves 41*c,k*, a cement mixer 42, a well control (WC) choke 45, and the MGS 46. When the drilling system 1 is in a drilling mode (not shown) and the deployment mode, the tank 35 may be filled with drilling fluid, such as mud (not shown). In the cementing mode, the tank 35 may be filled with chaser fluid 47. A booster supply line may be connected to an outlet of the mud tank 35 and an inlet of the booster pump 44. The choke shutoff valve 41*k*, the choke pressure gauge 37*k*, and the WC choke 45 may be assembled as part of the upper portion of the choke line 18*k*.

A first end of the return line 40 may be connected to the diverter outlet and a second end of the return line may be connected to an inlet of the shaker 36. The returns pressure gauge 37*r* may be assembled as part of the return line 40. A lower end of the mud line 39 may be connected to an outlet of the mud pump 34 and an upper end of the mud line may be connected to the top drive inlet. The mud pressure gauge 37*m* may be assembled as part of the mud line 39. An upper end of the cement line 14 may be connected to the cementing swivel inlet and a lower end of the cement line may be connected to an outlet of the cement pump 13. The cement shutoff valve 41*c* and the cement pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The CDA 9*d* may include a running tool 50, a plug release system 52, 53, and a packoff 51. The packoff 51 may be disposed in a recess of a housing of the running tool 50 and carry inner and outer seals for isolating an interface between the inner casing string 15 and the CDA 9*d* by engagement with a seal bore of a mandrel 15*m* thereof. The running tool housing may be connected to a housing of the plug release system 52, 53, such as by threaded couplings.

The plug release system 52, 53 may include an equalization valve 52 and a wiper plug 53. The equalization valve 52 may include a housing, an outer wall, a cap, a piston, a spring, a collet, and a seal insert. The housing, outer wall, and cap may be interconnected, such as by threaded couplings. The piston and spring may be disposed in an annular chamber formed radially between the housing and the outer wall and longitudinally between a shoulder of the housing and a shoulder of the cap. The piston may divide the chamber into an upper portion and a lower portion and carry a seal for isolating the portions. The cap and housing may also carry seals for isolating the portions. The spring may bias the piston toward the cap. The cap may have a port formed therethrough for providing fluid communication between an annulus 48 formed between the inner casing string 15 and the wellbore 24/outer casing string 25 and the chamber lower portion and the housing may have a port formed through a wall thereof for venting the upper chamber portion. An outlet port may be formed by a gap between a bottom of the housing and a top of the cap. As pressure from the annulus 48 acts against a lower surface of the piston through the cap passage, the piston may move upward and open the outlet port to facilitate equalization of pressure between the annulus and a bore of the housing to prevent surge pressure from prematurely releasing the wiper plug 53.

The wiper plug 53 may be made from one or more drillable materials and include a finned seal, a mandrel, a latch sleeve, and a lock sleeve. The latch sleeve may have a collet formed in an upper end thereof. The lock sleeve may have a seat and seal bore formed therein. The lock sleeve may be movable between an upper position and a lower position and be releasably restrained in the upper position by a shearable fastener. The shearable fastener may releasably connect the lock sleeve to the valve housing and the lock sleeve may be engaged with the valve collet in the upper position, thereby locking the valve collet into engagement with the collet of the latch sleeve. To facilitate subsequent drill-out, the plug mandrel may further have a portion of an auto-orienting torsional profile formed at a longitudinal end thereof. The plug mandrel may have male portion formed at the lower end thereof.

The inner casing string 15 may include a packer 15*p*, a casing hanger 15*h*, the mandrel 15*m* for carrying the hanger and packer and having the seal bore formed therein, joints of casing 15*j*, a plurality of centralizer subs 60*a-f*, a float collar 15*c*, and a guide shoe 15*s*. The inner casing components may be interconnected, such as by threaded couplings. The centralizer subs 60*a-f* may be spaced along the inner casing string 15, such as at regular intervals, and spaced apart by one or more casing joints 15*j*.

Alternatively, a lower portion of the inner casing string 15 adjacent to the lower formation 27*b* may have a lower spacing of the centralizer subs 60*c-f* less than an upper spacing of the centralizer subs 60*a,b* of an upper portion of the inner casing string adjacent to the outer casing string 25 such that the lower portion has a greater concentration of the centralizer subs. Alternatively, the centralizer subs 60*a,b* may be omitted from the upper portion of the inner casing string 15.

The float collar 15*c* may include a housing, a check valve, and a body. The body and check valve may be made from drillable materials. The body may have a bore formed therethrough and the torsional profile female portion formed in an upper end thereof for receiving the wiper plug 53. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the inner casing string 15, the drilling fluid may be pumped down at a sufficient pressure to overcome the bias of the spring, actuating the poppet downward to allow drilling fluid to flow through the bore of the body and into the annulus 48.

The guide shoe 15*s* may include a housing and a nose made from a drillable material. The nose may have a rounded distal end to guide the inner casing 15 down into the wellbore 24.

Alternatively, the guide shoe 15*s* and float collar 15*c* may interconnected by a centralizer sub. Alternatively, the guide shoe 15*s* and/or the float collar 15*c* may have a centralizer sub incorporated as a part thereof.

During deployment of the inner casing string 15, the workstring 9 may be lowered by the traveling block 11*t* and the drilling fluid may be pumped into the workstring bore by the mud pump 34 via the mud line 39 and top drive 5. The drilling fluid may flow down the workstring bore and the inner casing string bore and be discharged by the reamer shoe 15*s* into the annulus 48. The drilling fluid may flow up the annulus 48 and exit the wellbore 24 and flow into an annulus formed between the riser 17 and the workstring 9 via an annulus of the LMRP 16*b*, BOP stack, and wellhead 10. The drilling fluid may exit the riser annulus and enter the return line 40 via an annulus of the UMRP 16*u* and the diverter 19. The drilling fluid may flow through the return line 40 and into the shale shaker inlet. The drilling fluid may be processed by the shale shaker 36 to remove any particulates therefrom.

The workstring 9 may be lowered until the inner casing hanger 15*h* seats against a mating shoulder of the subsea wellhead 10. The workstring 9 may continued to be lowered, thereby releasing a shearable connection of the casing hanger 15*h* and driving a cone thereof into dogs thereof, thereby extending the dogs into engagement with a profile of the wellhead 10 and setting the hanger.

Once deployment of the inner casing string 15 has concluded, the workstring 9 may be disconnected from the top drive 5 and the cementing head 7 may be inserted and connected between the top drive 5 and the workstring 9. The cementing head 7 may include an isolation valve 6, an actuator swivel 7*a*, a cementing swivel 7*c*, a launcher 7*r*, and a control console 7*e*. The isolation valve 6 may be connected to a quill of the top drive 5 and an upper end of the actuator swivel 7*a*, such as by threaded couplings. An upper end of the workstring 9 may be connected to a lower end of the launcher 7*r*, such as by threaded couplings.

The cementing swivel 7*c* may include a housing torsionally connected to the derrick 3, such as by bars, wire rope, or a bracket (not shown). The torsional connection may accommodate longitudinal movement of the swivel 7*c* relative to the derrick 3. The cementing swivel 7*c* may further include a mandrel and bearings for supporting the housing from the mandrel while accommodating rotation of the mandrel. An upper end of the mandrel may be connected to a lower end of the actuator swivel 7*a*, such as by threaded couplings. The cementing swivel 7*c* may further include an inlet formed through a wall of the housing and in fluid communication with a port formed through the mandrel and a seal assembly for isolating the inlet-port communication. The mandrel port may provide fluid communication between a bore of the cementing head 7 and the housing inlet.

The actuator swivel 7*a* may be similar to the cementing swivel 7*c* except that the housing may have an inlet in fluid communication with a passage formed through the mandrel. The mandrel passage may extend to an outlet for connection to a hydraulic conduit for operating a hydraulic actuator of the launcher 7*r*. The actuator swivel inlet may be in fluid communication with a hydraulic power unit (HPU, not shown) operated by the control console 7*e*.

The launcher 7*r* may include a body, a deflector, a canister, a gate, an adapter, and the actuator. The body may be tubular and may have a bore therethrough. An upper end of the body may be connected to a lower end of the cementing swivel 7*c*, such as by threaded couplings, and a lower end of the body may be connected to the adapter, such as by threaded couplings. The adapter may have a threaded coupling at a lower end thereof for connection to the top of the workstring 9. The canister and deflector may each be disposed in the body bore. The deflector may be connected to the cementing swivel mandrel, such as by threaded couplings. The canister may be longitudinally movable relative to the body. The canister may be tubular and have ribs formed along and around an outer surface thereof. Bypass passages (only one shown) may be formed between the ribs. Each canister may further have a landing shoulder formed in a lower end thereof for receipt by a landing shoulder of the adapter. The deflector may be operable to divert fluid received from a cement line 14 away from a bore of the canister and toward the bypass passages.

A release plug, such as a dart 59, may be disposed in the canister bore. The dart 59 may be made from one or more drillable materials and include a finned seal and mandrel. Each mandrel may be made from a metal or alloy and may have a landing shoulder and carry a landing seal for engagement with the seat and seal bore of the wiper plug 53.

The gate may include a housing, a plunger, and a shaft. The housing may be connected to a respective lug formed in an outer surface of the body, such as by threaded couplings. The plunger may be longitudinally movable relative to the housing and radially movable relative to the body between a capture position and a release position. The plunger may be moved between the positions by a linkage, such as a jackscrew, with the shaft. Each shaft may be longitudinally connected to and rotatable relative to the housing. Each actuator may be a hydraulic motor operable to rotate the shaft relative to the housing. The actuator may include a reservoir (not shown) for receiving the spent hydraulic fluid or the cementing head 7 may include a second actuator swivel and hydraulic conduit (not shown) for returning the spent hydraulic fluid to the HPU.

In operation, when it is desired to launch the dart 59, the console 7*e* may be operated to supply hydraulic fluid to the launcher actuator via the actuator swivel 7*a*. The launcher actuator may then move the plunger to the release position. The canister and dart 59 may then move downward relative to the body until the landing shoulders engage. Engagement of the landing shoulders may close the canister bypass passages, thereby forcing chaser fluid 47 to flow into the canister bore. The chaser fluid 47 may then propel the dart 59 from the canister bore into a bore of the adapter and onward through the workstring 9.

Alternatively, the actuator swivel 7*a* and launcher actuator may be pneumatic or electric. Alternatively, the launcher actuator may be linear, such as a piston and cylinder. Alternatively, the launcher may include a main body having a main bore and a parallel side bore, with both bores being machined integral to the main body. The dart 59 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart 59 may be maintained in the main bore with the dart releaser valve closed. Fluid may flow through the side bore and into the main bore below the dart via the fluid communication port in the dart releaser valve. To release the dart 59, the dart releaser valve may be turned, such as by ninety degrees, thereby closing the side bore and opening the main bore through the dart releaser valve. The chaser fluid 47 may then enter the main bore behind the dart 59, causing it to drop downhole.

Figure 2A:
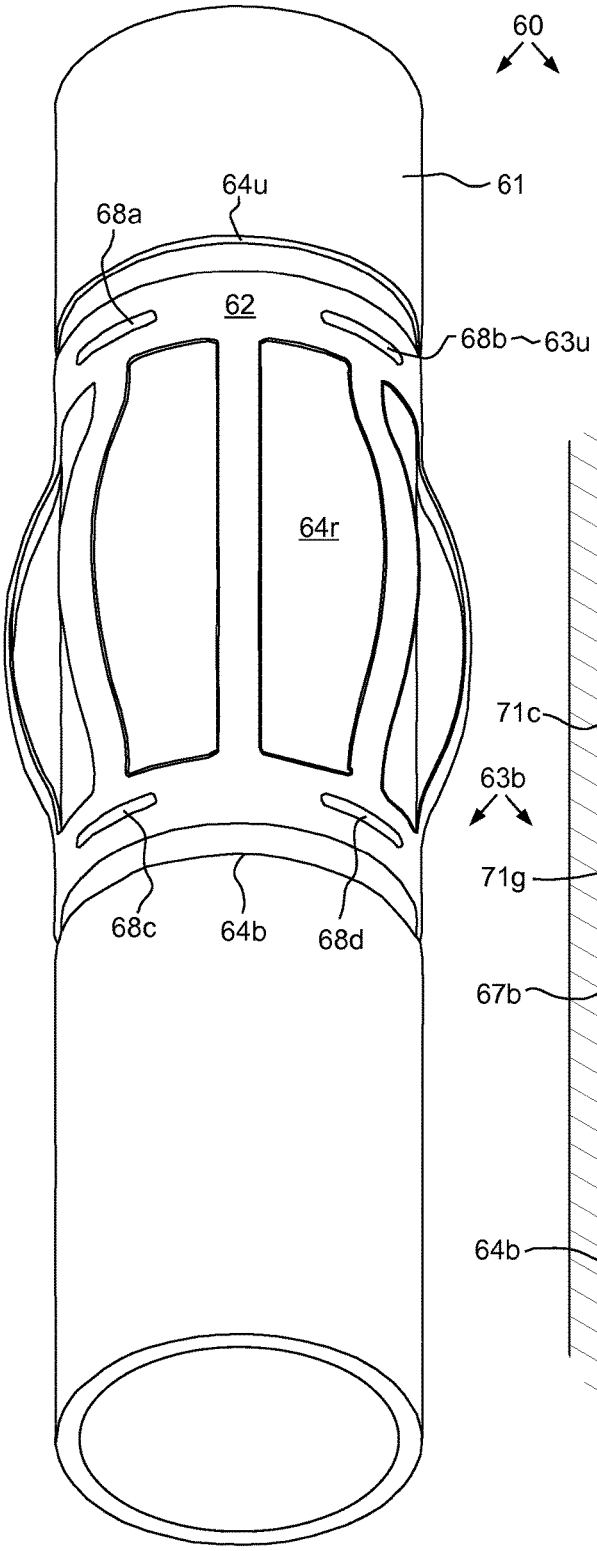
FIGS. 2A and 2B illustrate a typical one of the centralizer subs of the casing string.
Figure 2B:
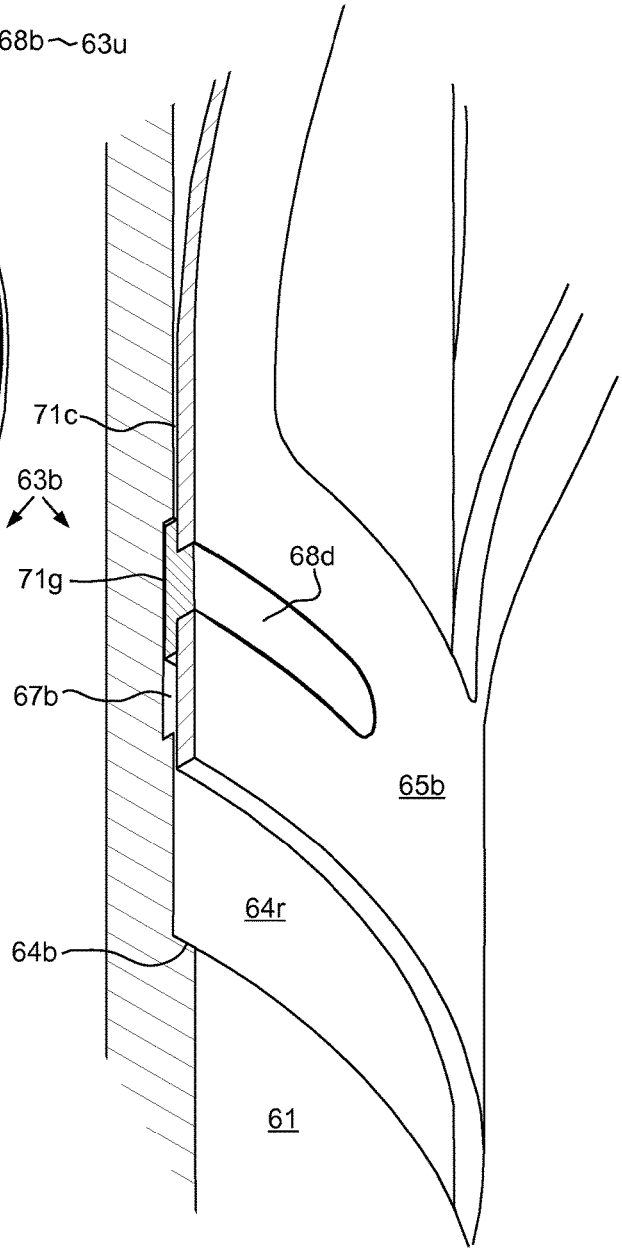

FIGS. 2A and 2B illustrate a typical one 60 of the centralizer subs 60*a-f* of the inner casing string 15. The centralizer sub 60 may include a body 61, a centralizer 62, and one or more slip joints, such as an upper slip joint 63*u* and a lower slip joint 63*b*. The body 61 may be tubular and have threaded couplings, such as a pin or box 74 (FIG. 5A), formed at longitudinal ends thereof for connection to joints 15*j* of the inner casing string 15. The body 61 may have a recessed portion 64*r* formed in an outer surface thereof for receiving the centralizer 62. The recessed portion 64*r* may extend along the body outer surface between upper 64*u* and lower 64*b* shoulders formed in the body outer surface. A length of the recessed portion 64*r* may be greater than a length of the centralizer 62 in a compressed position (not shown) and a depth of the recessed portion may be greater than or equal to a thickness of the centralizer 62 such that the centralizer may be flush or sub-flush with the shoulders 64*u,b* when in the compressed position.

The body 61 may be of one-piece construction and may be made from a metal or alloy, such as steel or corrosion resistant alloy. The steel may be plain carbon, low alloy, or high strength low alloy and not boron steel. The corrosion resistant alloy may be stainless steel or nickel based alloy. The body material may be compatible with the casing joint material and have a strength sufficient such that a burst, collapse, and tensile rating of the body 61 equals or exceeds that of the casing joints 15*j*. An inner diameter of a bore of the body 61 may be greater than or equal to a drift diameter of the casing joints 15*j*.

Figure 2C:
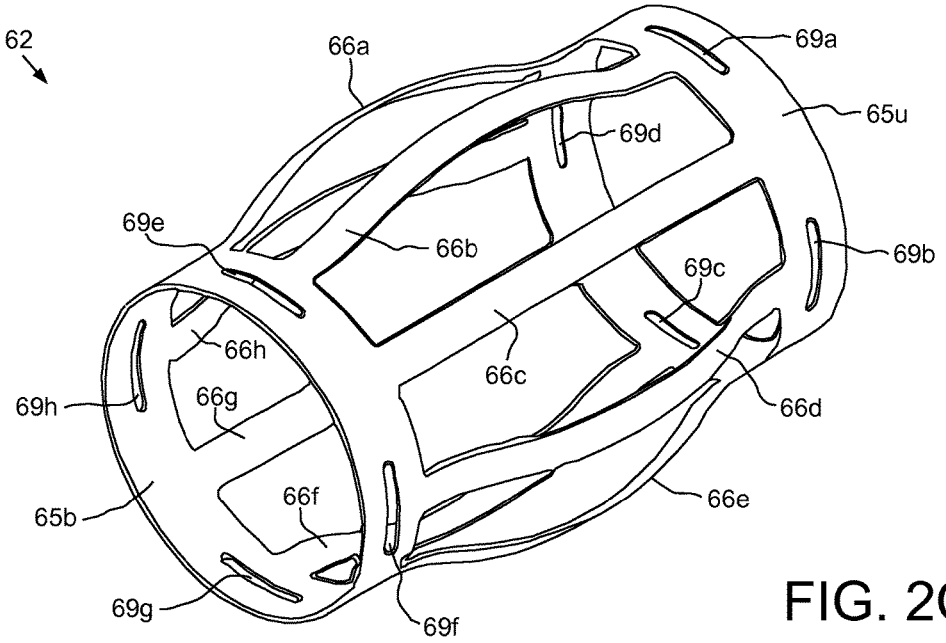
FIG. 2C illustrates a centralizer of the centralizer sub.

FIG. 2C illustrates the centralizer 62. The centralizer 62 may include an upper collar 65*u*, a lower collar 65*b*, and a plurality of bow springs 66*a-h* connecting the collars. The bow springs 66*a-h* may be spaced around the centralizer 62, such as at regular intervals (eight at forty-five degrees shown). Bypass passages may be formed between the bow springs 66*a-h* to accommodate fluid flow through the annulus 48. The bow springs 66*a-h* may each be identical. Each of the bow springs 66*a-h* may be parabolic and radially movable between an expanded position (shown) and the compressed position. The centralizer 62 may longitudinally extend when moving from the expanded position to the compressed position and longitudinally contract when moving from the compressed position to the expanded position. The bow springs 66*a-h* may be naturally biased toward the expanded position and an expanded diameter of the centralizer 62 may correspond to a diameter of the wellbore 24. For the lower centralizers 60*c-f*, engagement of the bow springs 66*a-h* with a wall of the wellbore 24 may bias the inner casing string 15 toward a central position within the wellbore. For the upper centralizers 60*a,b*, engagement of the bow springs 66*a-h* with an inner surface of the outer casing 25 may bias the inner casing string 15 toward a central position within the outer casing.

Figure 2D:
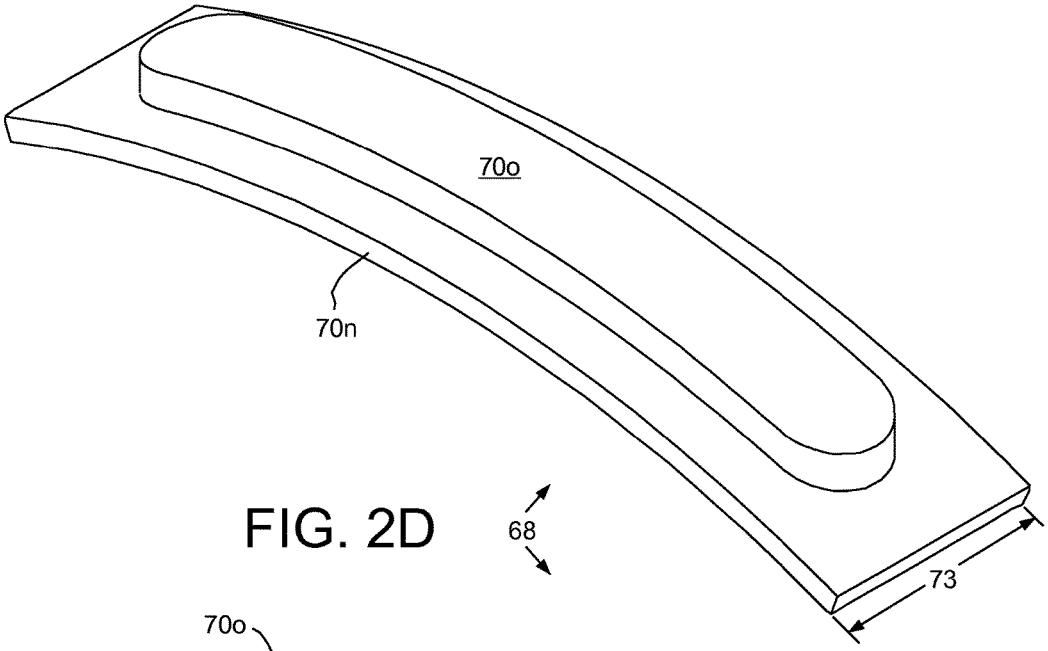
FIGS. 2D and 2E illustrate a lug of the centralizer sub.
Figure 2E:
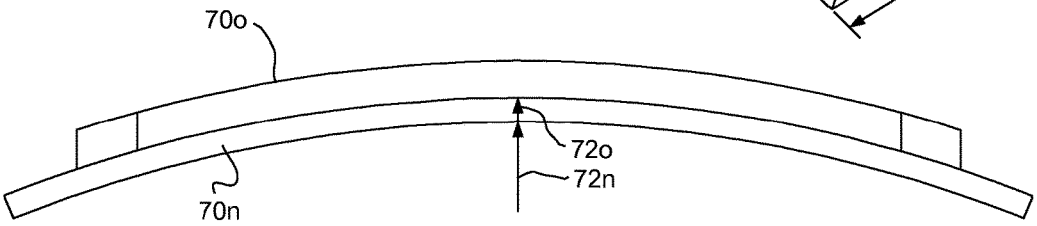

FIGS. 2D and 2E illustrate a typical lug 68 of the centralizer sub 60. Each slip joint 63*u,b* may include a groove 67*u,b* (lower groove 67*b* shown in FIG. 2B and upper groove 67*u* shown in FIG. 4B), a plurality of protrusions, such as lugs 68*a-d* (shown in FIG. 2A), and one or more slots 69*a-h*. The slip joints 63*u,b* may longitudinally link the centralizer 62 to the body 61 while accommodating extension and contraction of the centralizer due to the expansion and compression of the bow springs 66*a-h*. Each groove 67*u,b* may be formed in and around the body recessed portion 64*r* adjacent to a respective shoulder 64*u,b* for receiving inner portions 70*n* of a respective set 68*a,b*, 68*c,d* of lugs 68*a-d*.

Figure 2F:
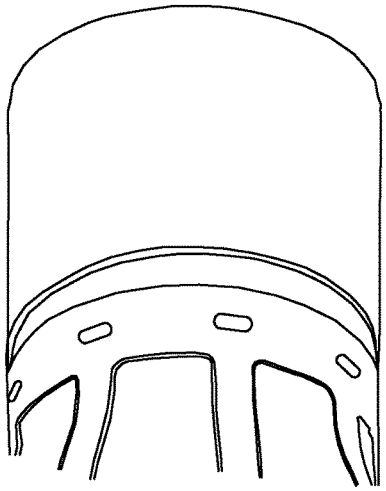
FIG. 2F illustrates an alternative lug configuration of the centralizer sub, according to another embodiment of this disclosure.

An outer portion 70*o* of each lug 68*a-d* may be received in a respective slot 69*a-h* formed through a respective collar 65*u,b*. An upper set 69*a-d* of slots 69*a-h* may be formed through the upper collar 65*u* and a lower set 69*e-h* of slots may be formed through the lower collar 65*b*. Each set 69*a-d*, 69*e-h* may be spaced around the respective collar 65*u,b*, such as at regular intervals (four at ninety degrees shown). The number of slots 69*a-h* in each set 69*a-d*, 69*e-h* may be proportional to the number of bow springs 66*a-h*, such as a slot for every other bow spring 66*a-h* (shown) or a slot for every bow spring (FIG. 2F). The slots 69*a-h* may be aligned with the respective bow springs 66*a-h*. Each slot 69*a-h* may be circumferential and have a width corresponding to the spacing between each bow spring 66*a-h* (shown) or a width corresponding to a width of each bow (FIG. 2F).

Alternatively, the number and/or placement of lugs 68*a-d* and slots 69*a-h* may be independent of the number and/or placement of the bow springs 66*a-h*.

The centralizer 62 may be of one-piece construction and may be made from ductile metal or alloy, such as steel, or a fiber reinforced composite. The steel may be plain carbon or low alloy steel and not boron steel. The centralizer 62 may be formed starting with sheet metal. The sheet may be cut to form bow strips and the slots 69*a-h*, such as by a CNC machine tool having a laser, plasma, or water jet cutter. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. The lugs 68*a-d* may then be inserted into the respective slots 69*a-h* from underneath the respective collars 65*u,b*. The lugs 68*a-d* may then be mounted to the respective collars 65*u,b*, such as by fusion welding, interference fit, or bonding using an adhesive. A protective coating may then be applied to the split cylindrical assembly to resist corrosion in the wellbore 24. The split cylindrical assembly may then be slid over the body 61 into the recessed portion 64*r*. Seams formed between respective ends of collar portions of the assembly may then be joined, such as by seam welding. The seam welding may be accomplished by electric resistance welding. The seam weld may be a butt joint. A protective coating may then be applied to the seam weld.

Each lug 68 may be an arcuate segment having a T-shaped cross section through the inner 70*n* and outer 70*o* portions. Each lug 68 may be made from any of the body or centralizer materials discussed above or a bearing material, such as Babbitt metal, bi-metal, bi-material, brass, bronze, cast iron, graphite, engineering polymer, or lubricant infused alloy composite. The lugs 68*a-d* may be manufactured by machining a metallic ring and then severing the machined ring into ring segments, by investment casting, by forging, or by sintering. Each outer portion 70*o* may be sized to fit snugly in the respective slot 69*a-h*, thereby longitudinally and torsionally connecting the lugs 68*a-d* to the centralizer 62. Each inner portion 70*n* may have a length and a width greater than that of each outer portion 70*o* to serve as a flange for engagement with the inner surface of the respective collar 65*u,b*. A thickness of each outer portion 70*o* may be less than or equal to a thickness of the collars 65*u,b* such that the lugs 68*a-d* are flush or sub-flush with an outer surface of the collars when mounted in the centralizer 62.

Alternatively, the sheet may be formed into a split cylindrical shape before cutting the bow strips and slots 69*a-h*. Alternatively, the split cylindrical shape may be plastically expanded before cutting the bow strips and slots 69*a-h*. Alternatively, the lugs 68*a-d* may be manufactured by injection molding or reaction injection molding.

The collars 65*u,b* may have an inner diameter slightly greater than an outer diameter of the recessed portion 64*r*, thereby forming a clearance 71*c* between the centralizer 62 and the body 61. The collar clearance 71*c* may accommodate rotation 49 of the body 61 relative to the centralizer 62. When mounted in the centralizer 62, each set 68*a,b*, 68*c,d* of the lugs 68*a-d* may have an effective inner diameter 72*n* slightly greater than a diameter of the respective groove 67*u,b* and less than a diameter of the recessed portion 64*r*, thereby forming a clearance 71*g* between the lugs and the body 61 and trapping the lugs within the respective grooves. The lug clearance 71*g* may be less than the collar clearance 71*c* but still sufficient to accommodate rotation 49 of the body 61 relative to the lugs 68*a-d*. An effective outer diameter 72*o* of the inner portions 70*n* (when mounted and equal to the collar inner diameter) may be slightly greater than the recessed portion diameter.

Alternatively, the lug clearance 71*g* may be greater than or equal to the collar clearance 71*c* while maintaining entrapment of the lugs 68*a-d* within the respective grooves 67*u,b*.

A length of each groove 67*u,b* may correspond to a stroke length of the centralizer 62. The stroke length of the centralizer 62 may be a differential between the extended length thereof (when the bow springs 66*a-h* are compressed) and the contracted length thereof (when the bow springs are expanded). The groove length may be greater than or equal to a sum of a length 73 of the lug 68 plus the stroke length, thereby accommodating expansion and contraction of the centralizer 62.

Upon encountering a restriction during lowering of the inner casing string 15, the centralizer 62 may be stopped by the restriction while the body 61 continues downward movement until engagement of an upper face of the lower groove 67*b* with an upper face of the lower lugs 68*c,d*. The engagement may then pull the centralizer 62 through the restriction as the bow springs 66*a-h* compress. The resultant extension of the centralizer 62 may be accommodated by movement of the upper lugs 68*a,b* along the upper groove 67*u* until the bow springs 66*a-h* have compressed enough to pass through the restriction. Pulling the centralizer 62 through the restriction may reduce the insertion force as compared to trying to push the centralizer through the restriction.

Inclusion of the upper slip joint 63*u* may provide a similar pulling capability if it becomes necessary to raise the inner casing string 15 through a restriction and/or reciprocate the inner casing string. If the need to raise and/or reciprocate the inner casing string 15 is not envisioned, the upper slip joint 63*u* may be omitted. If the upper slip joint 63*u* is omitted, then the lower groove 67*b* may also be shortened as it will no longer need to accommodate extension and contraction of the centralizer 62 since the upper collar 65*u* will be free to move relative to the body 61.

Figure 2G:
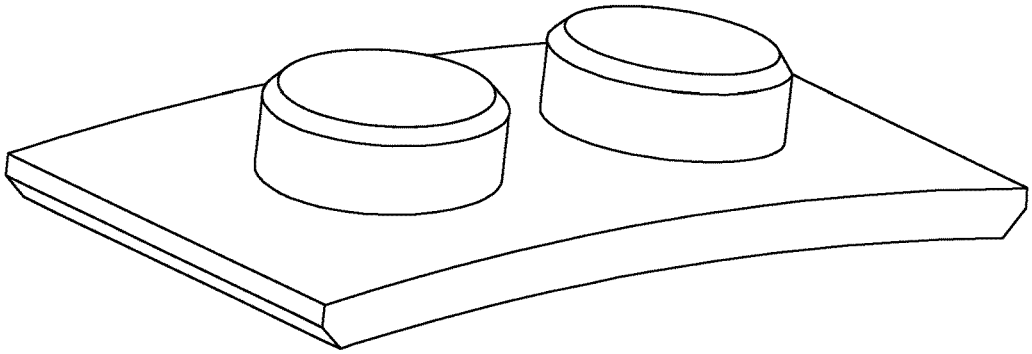
FIGS. 2G-2K illustrate alternative lug shapes, according to other embodiments of this disclosure.
Figure 2H:
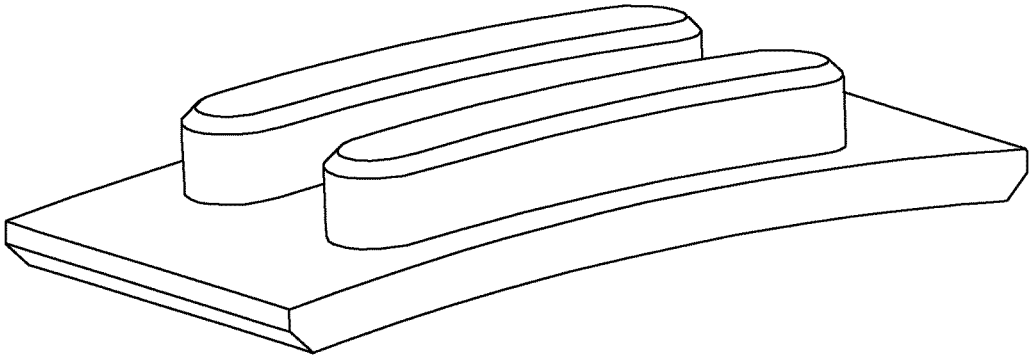
Figure 2I:
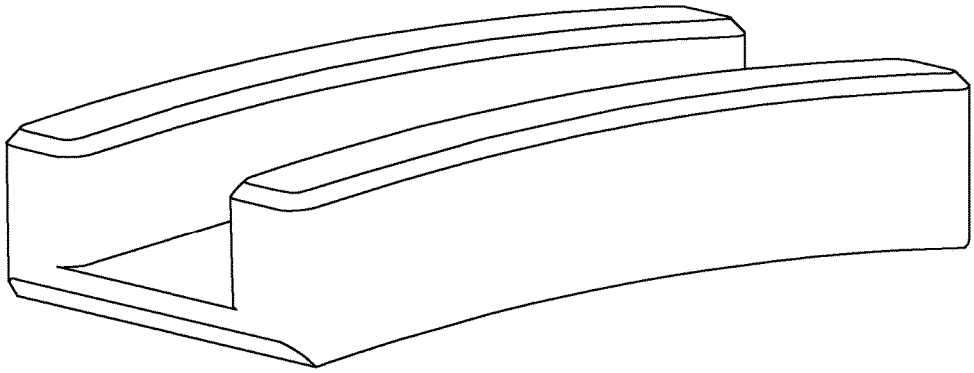
Figure 2J:
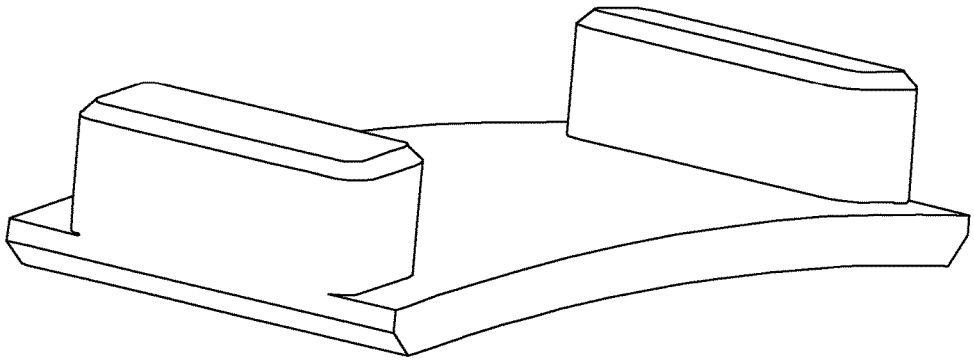
Figure 2K:
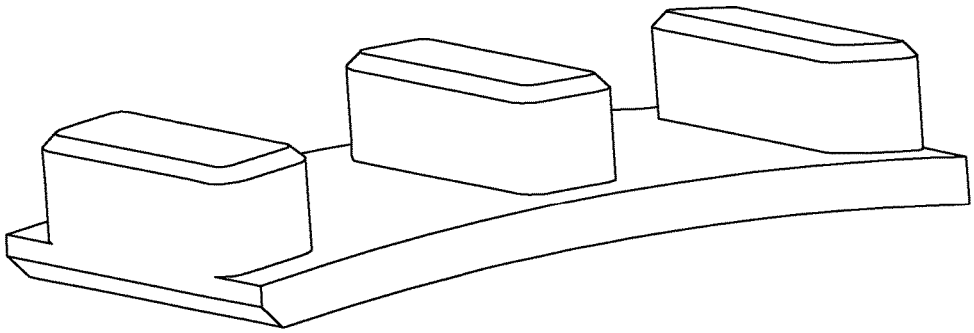

FIGS. 2G-2K illustrate alternative lug shapes, according to other embodiments of this disclosure. Instead of the outer portion 70*o* of each lug 68 being a continuous piece conforming to the shape of the respective slot 69*a-h*, a modified outer portion may include a plurality of discrete fasteners, such as studs (FIG. 2G) or slats (FIGS. 2H-2K). The discrete fasteners may be arranged circumferentially (FIGS. 2G, 2J, and 2K) or longitudinally (FIGS. 2H and 2I) on the respective inner portion. The discrete fasteners may overlap with circumferential ends of the inner portion (FIGS. 2I-2K), may overlap with longitudinal ends of the inner portion (FIG. 2I), or may be offset from the longitudinal and circumferential ends of the inner portion (FIGS. 2G and 2H).

Figure 2L:
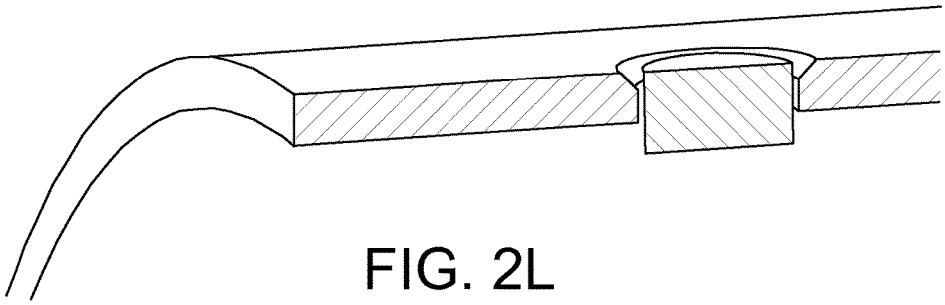
FIG. 2L illustrates another alternative lug configuration of the centralizer sub, according to another embodiment of this disclosure.

FIG. 2L illustrates another alternative lug configuration of the centralizer sub, according to another embodiment of this disclosure. Instead of the lugs 68*a-d* being inserted into the respective slots 69*a-h* from underneath the respective collars 65*u,b*, the alternative configuration may include lugs (only one shown) inserted into respective openings, such as holes, from outside the respective collars. The lugs of the alternative configuration may be studs and may be mounted to the respective collars, such as by fusion welding or interference fit.

FIGS. 3A-3D illustrate cementing of the inner casing string 15. The inner casing string 15 may be rotated 49 by operation of the top drive 5 (via the workstring 9) and rotation may continue during injection of cement slurry 54 into the annulus 48. Conditioner 43 may be circulated through the annulus 48 by the cement pump 13 through the valve 41*c* to prepare for pumping of the cement slurry 54. Once the annulus has been conditioned, the cement slurry 54 may be pumped from the mixer 42 into the cementing swivel 7*c* via the valve 41*c* by the cement pump 13. The cement slurry 54 may flow into the launcher 7*r* and be diverted past the dart 59 via the diverter and bypass passages. Once the desired quantity of cement slurry 54 has been pumped, the dart 59 may be released from the launcher 7*r* by operating the launcher actuator. The chaser fluid 47 may be pumped into the cementing swivel 7*c* via the valve 41 by the cement pump 13. The chaser fluid 47 may flow into the launcher 7*r* and be forced behind the dart 59 by closing of the bypass passages, thereby propelling the dart into the plug detector bore.

Pumping of the chaser fluid 47 by the cement pump 13 may continue until residual cement in the cement line 14 has been purged. Pumping of the chaser fluid 47 may then be transferred to the mud pump 34 by closing the valve 41*c* and opening the valve 6. The dart 59 and cement slurry 54 may be driven through the workstring bore by the chaser fluid 47. The dart 59 may reach the wiper plug 53 and the landing shoulder and seal of the dart may engage the seat and seal bore of the wiper plug.

Continued pumping of the chaser fluid 47 may increase pressure in the workstring bore against the seated dart 59 until a release pressure is achieved, thereby fracturing the shearable fastener. The dart 59 and lock sleeve of the wiper plug 53 may travel downward until reaching a stop of the wiper plug, thereby freeing the collet of the latch sleeve and releasing the wiper plug from the equalization valve 52. Continued pumping of the chaser fluid 47 may drive the dart 59, wiper plug 53, and cement slurry 54 through the inner casing bore. The cement slurry 54 may flow through the float collar 15*c* and the guide shoe 15*s*, and upward into the annulus 48.

Pumping of the chaser fluid 47 may continue to drive the cement slurry 7*c* into the annulus 48 until the wiper plug 53 bumps the float collar 15*c*. Pumping of the chaser fluid 47 may then be halted and rotation 49 of the inner casing string 15 may also be halted. The float collar check valve may close in response to halting of the pumping. The workstring 9 may then be lowered to drive a wedge of the casing packer 15*p* into a metallic seal ring thereof, thereby extending the seal ring into engagement with a seal bore of the wellhead 10 and setting the packer. The bayonet connection may be released and the workstring 9 may be retrieved to the rig 1*r*.

Additionally, the cementing head 7 may include a second launcher located below the launcher 7*r* and having a bottom dart and the plug release system 52, 53 may include a bottom wiper plug located below the wiper plug 53 and having a burst tube. The bottom dart may be launched just before pumping of the cement slurry 54 and release the bottom wiper plug. Once the bottom wiper plug bumps the float collar 15*c*, the burst tube may rupture, thereby allowing the cement slurry 54 to bypass the seated bottom plug. In a further addition to this alternative, a third dart and third wiper plug, each similar to the bottom dart and bottom plug may be employed to pump a slug of spacer fluid just before pumping of the cement slurry 54.

Alternatively, a liner string may be hung from a lower portion of the outer casing string 25 and used to line the lower formation 27*b* instead of the inner casing string 15. The liner string may include the lower centralizers 60*c-f* and be cemented into the wellbore 24 in a similar fashion as the inner casing string 15. Alternatively, a lower portion of the wellbore 24 maybe deviated instead of vertical, such as slanted or horizontal.

Figure 4A:
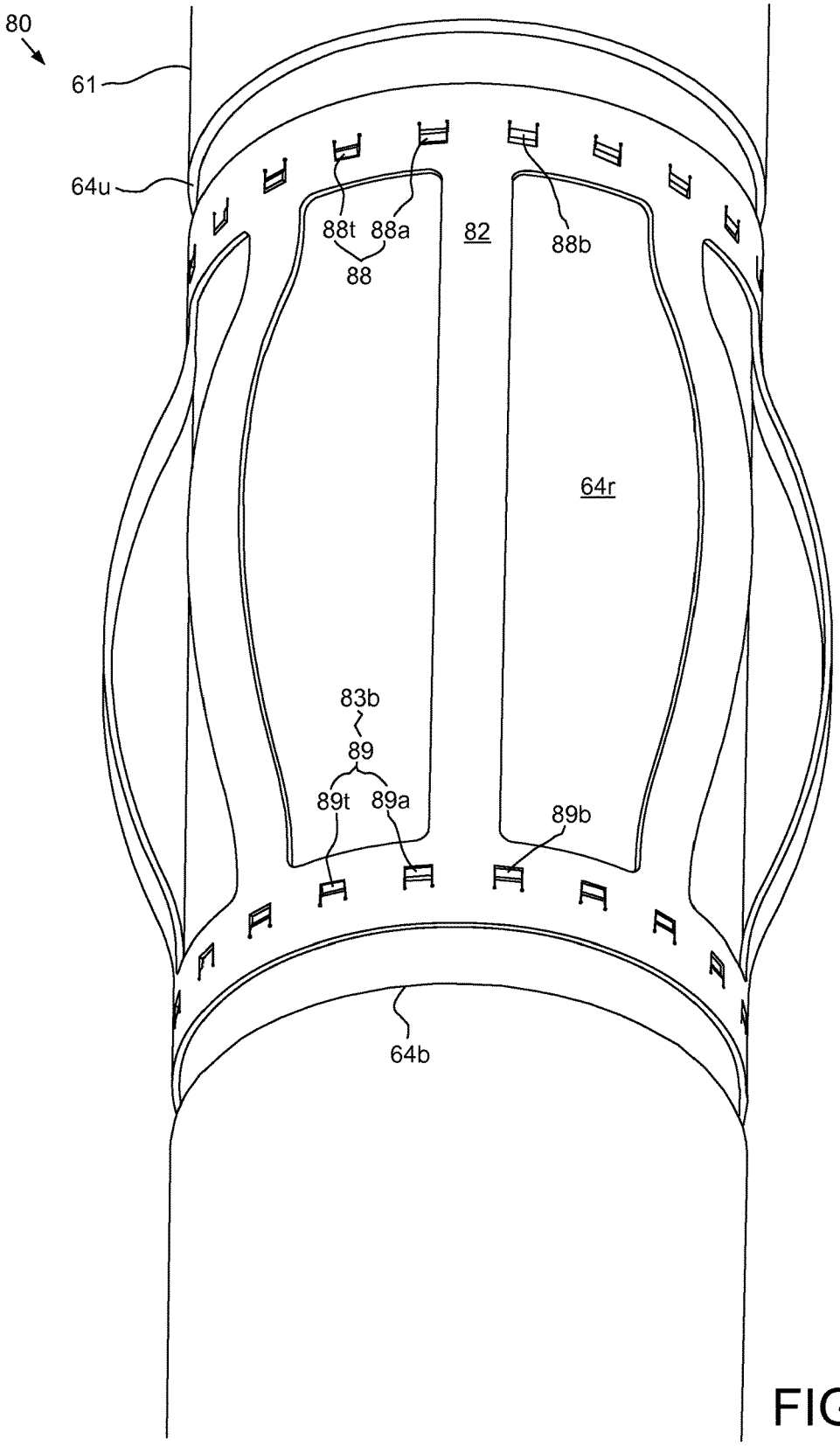
FIGS. 4A-4C illustrate an alternative centralizer sub, according to another embodiment of this disclosure.
Figure 4B:
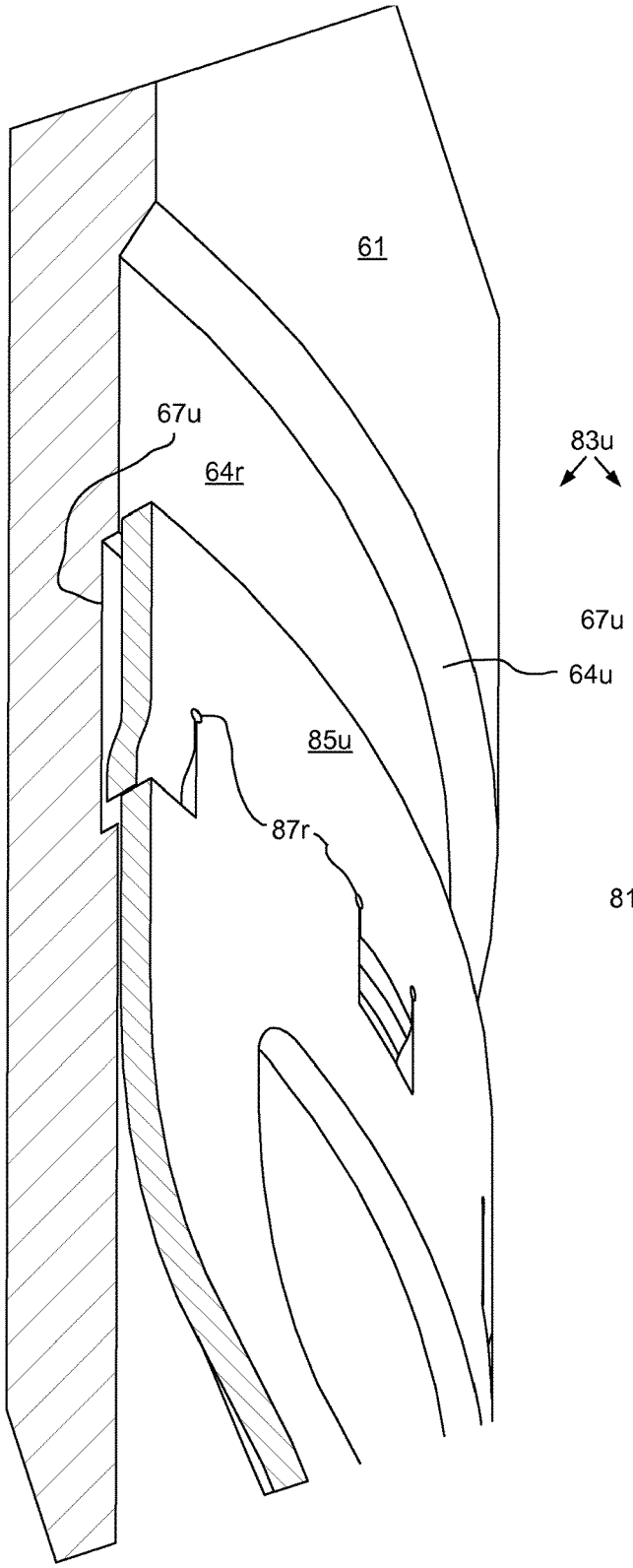
Figure 4C:
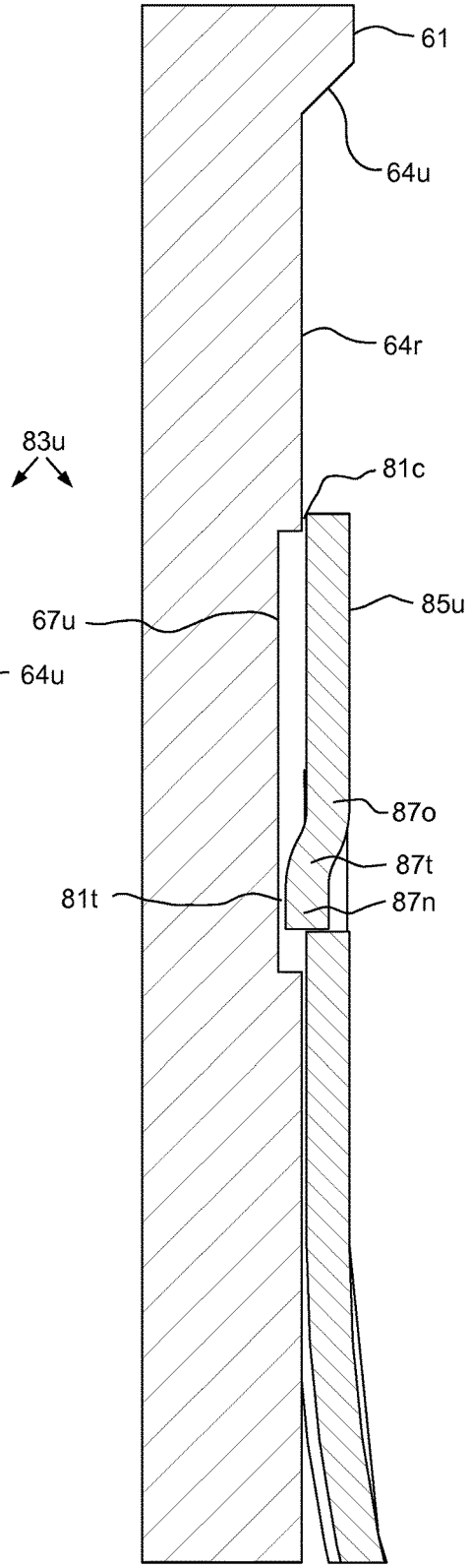

FIGS. 4A-4C illustrate an alternative centralizer sub 80, according to another embodiment of this disclosure. A plurality of the alternative centralizer subs 80 may be assembled with the inner casing string 15 instead of the centralizer subs 60*a-f*. The alternative centralizer sub 80 may include the body 61, a centralizer 82, and one or more slip joints, such as an upper slip joint 83*u* and a lower slip joint 83*b*.

Figure 4D:
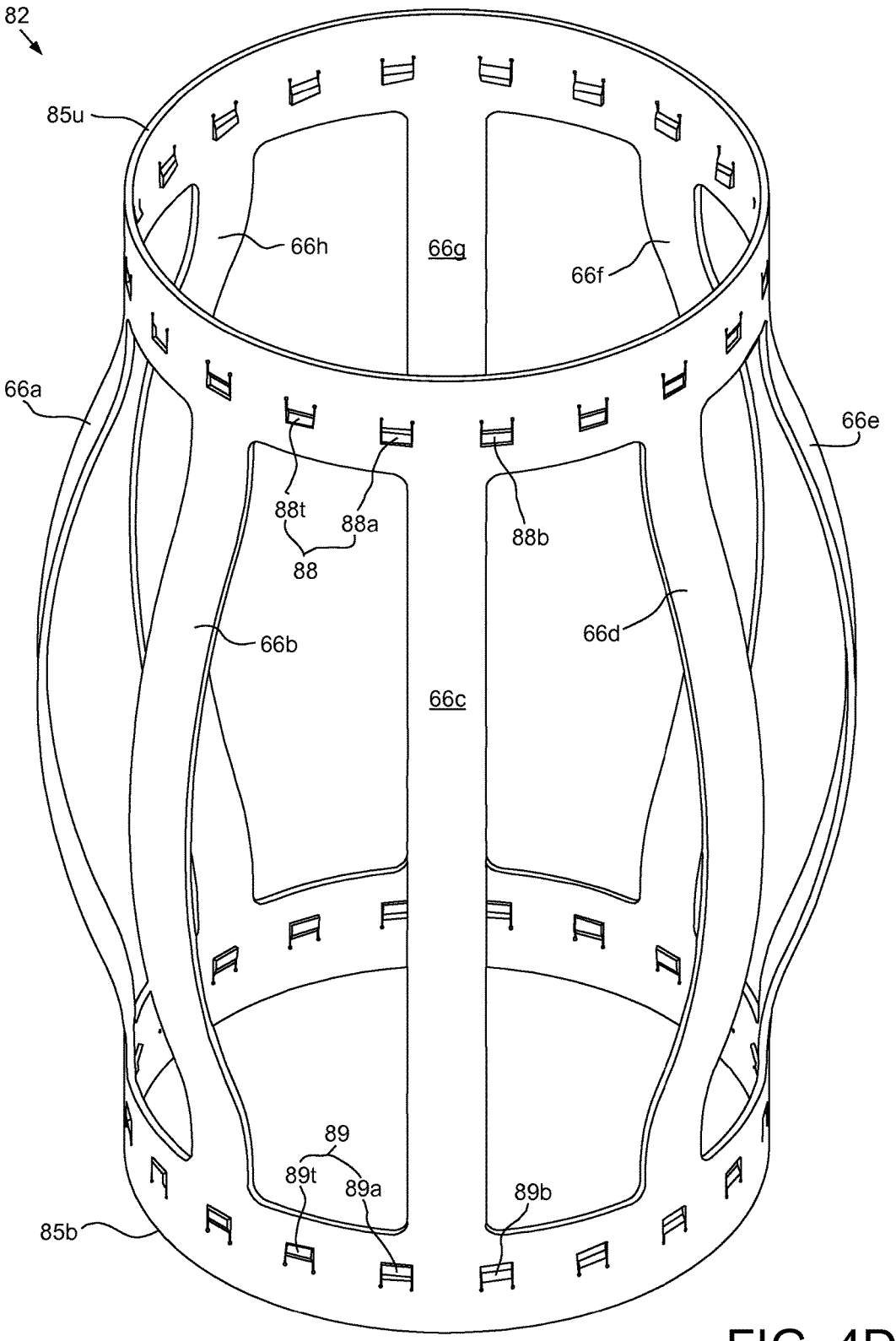
FIGS. 4D-4F illustrates a centralizer of the alternative centralizer sub.
Figure 4E:
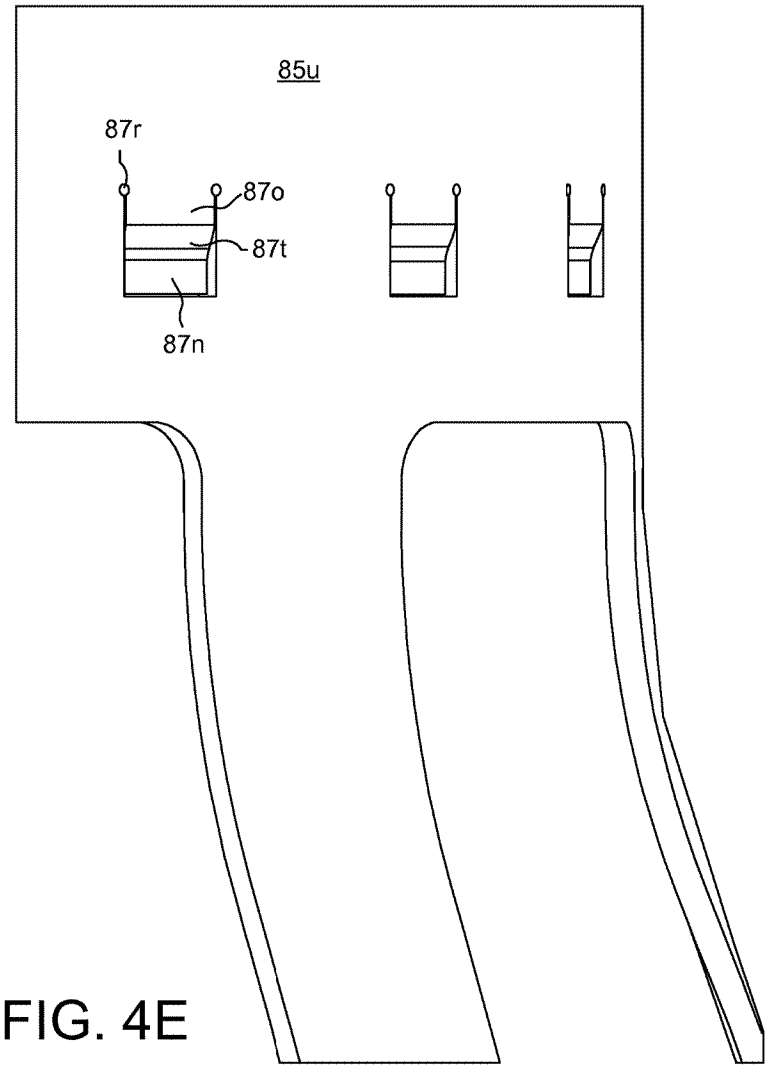
Figure 4F:
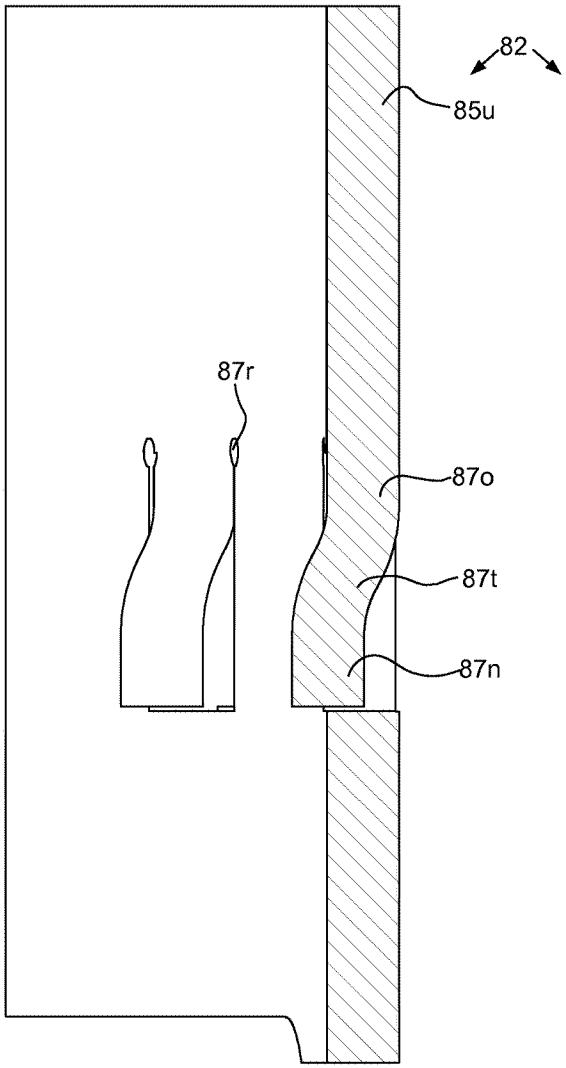

FIGS. 4D-4F illustrates the centralizer 82. The centralizer 82 may include an upper collar 85*u*, a lower collar 85*b*, and a plurality of bow springs 66*a-h* connecting the collars. The centralizer 82 may longitudinally extend when moving from the expanded position to the compressed position and longitudinally contract when moving from the compressed position to the expanded position. Each slip joint 83*u,b* may include the respective groove 67*u,b* and a plurality of protrusions, such as tabs 88*a-t*, 89*a-t*. The slip joints 83*u,b* may longitudinally link the centralizer 82 to the body 61 while accommodating extension and contraction of the centralizer due to the expansion and compression of the bow springs 66*a-h*. Each groove 67*u,b* may be formed in and around the body recessed portion 64*r* adjacent to a respective shoulder 64*u,b* for receiving inner portions 87*n* of a respective set 88, 89 of tabs 88*a-t*, 89*a-t*.

Each set 88, 89 of tabs 88*a-t*, 89*a-t* may be integrally formed with the respective collar 85*u,b*. Each set 88, 89 may be spaced around the respective collar 65*u,b*, such as at regular intervals (twenty at eighteen degrees shown). Each tab 88*a-t*, 89*a-t* may be rectangular having three free sides and one connected side. Each tab 88*a-t*, 89*a-t* may have the inner portion 87*n* protruding inwardly from the respective collar 85*u,b*, an outer portion 87*o* connecting the inner portion to the respective collar, and a tapered portion 87*t* connecting the inner and outer portions. In order to provide the pulling capability, discussed above, the inner portions 87*n* of each set 88, 89 may be located proximate to the bow springs 66*a-h* and the outer portions 87*o* of each set 88, 89 may be located distal from the bow springs. Otherwise, the cantilever spring nature of the tabs 88*a-t*, 89*a-t* may cause operation as a detent instead of a shoulder. Each tab 88*a-t*, 89*a-t* may further have a stress relief, such as a hole 87*r*, formed at each corner thereof adjacent to the outer portion 87*o* thereof.

The centralizer 82 may be of one-piece construction and may be made from any of the materials discussed above for the centralizer 62. The centralizer 82 may be formed starting with sheet metal. The sheet may be cut to form bow strips and tab strips, such as by a CNC machine tool having a laser, plasma, or water jet cutter. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. The tab strips may then be plastically formed into the tabs 88*a-t*, 89*a-t*, such as with a punch-press. A protective coating may then be applied to the split cylindrical assembly to resist corrosion in the wellbore 24. The split cylindrical assembly may then be slid over the body 61 into the recessed portion 64*r*. Seams formed between respective ends of collar portions of the assembly may then be joined, such as by seam welding. The seam welding may be accomplished by electric resistance welding. The seam weld may be a butt joint. A protective coating may then be applied to the seam weld.

Alternatively, the tabs 88*a-t*, 89*a-t* may be circular, elliptical, or oval instead of rectangular. Alternatively, the sheet may be formed into a split cylindrical shape before cutting the bow strips and tab strips. Alternatively, the split cylindrical shape may be plastically expanded before cutting the bow strips and tab strips.

The collars 85*u,b* may have an inner diameter slightly greater than an outer diameter of the recessed portion 64*r*, thereby forming a clearance 81*c* between the centralizer 82 and the body 61. The collar clearance 81*c* may accommodate rotation 49 of the body 61 relative to the centralizer 82. Each set 88, 89 may have an effective inner diameter slightly greater than a diameter of the respective groove 67*u,b* and less than a diameter of the recessed portion 64*r*, thereby forming a clearance 81*t* between the tabs 88*a-t*, 89*a-t* and the body 61 and trapping the tabs within the respective grooves 67*b*. The tab clearance 81*t* may be sufficient to accommodate rotation 49 of the body 61 relative to the tabs 88*a-t*, 89*a-t*. A length of each groove 67*u,b* may correspond to a stroke length of the centralizer 82. The groove length may be greater than or equal to a sum of a length of the inner portion 87*n* plus the stroke length, thereby accommodating expansion and contraction of the centralizer 82.

Upon encountering a restriction during lowering of the inner casing string 15, the centralizer 82 may be stopped by the restriction while the body 61 continues downward movement until engagement of an upper face of the lower groove 67*b* with an upper face of the lower tabs 89*a-t*. The engagement may then pull the centralizer 82 through the restriction as the bow springs 66*a-h* compress. The resultant extension of the centralizer 82 may be accommodated by movement of the upper tabs 88*a-t* along the upper groove 67*u* until the bow springs 66*a-h* have compressed enough to pass through the restriction.

Inclusion of the upper slip joint 83*u* may provide a similar pulling capability if it becomes necessary to raise the inner casing string 15 through a restriction and/or reciprocate the inner casing string. If the need to raise and/or reciprocate the inner casing string 15 is not envisioned, the upper slip joint 83*u* may be omitted. If the upper slip joint 83*u* is omitted, then the lower groove 67*b* may also be shortened as it will no longer need to accommodate extension and contraction of the centralizer 82 since the upper collar 83*u* will be free to move relative to the body 61.

Figure 5A:
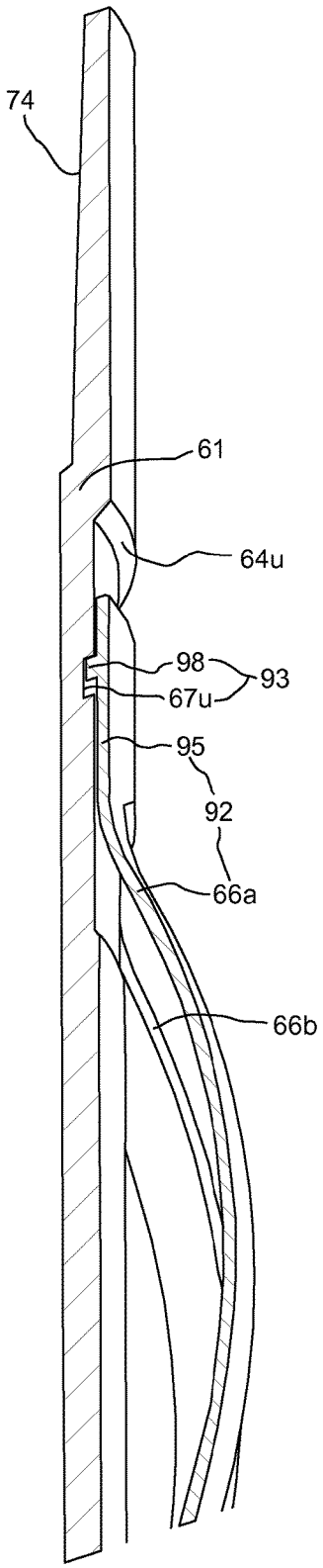
FIGS. 5A and 5B illustrate a second alternative centralizer sub, according to another embodiment of this disclosure.
Figure 5B:
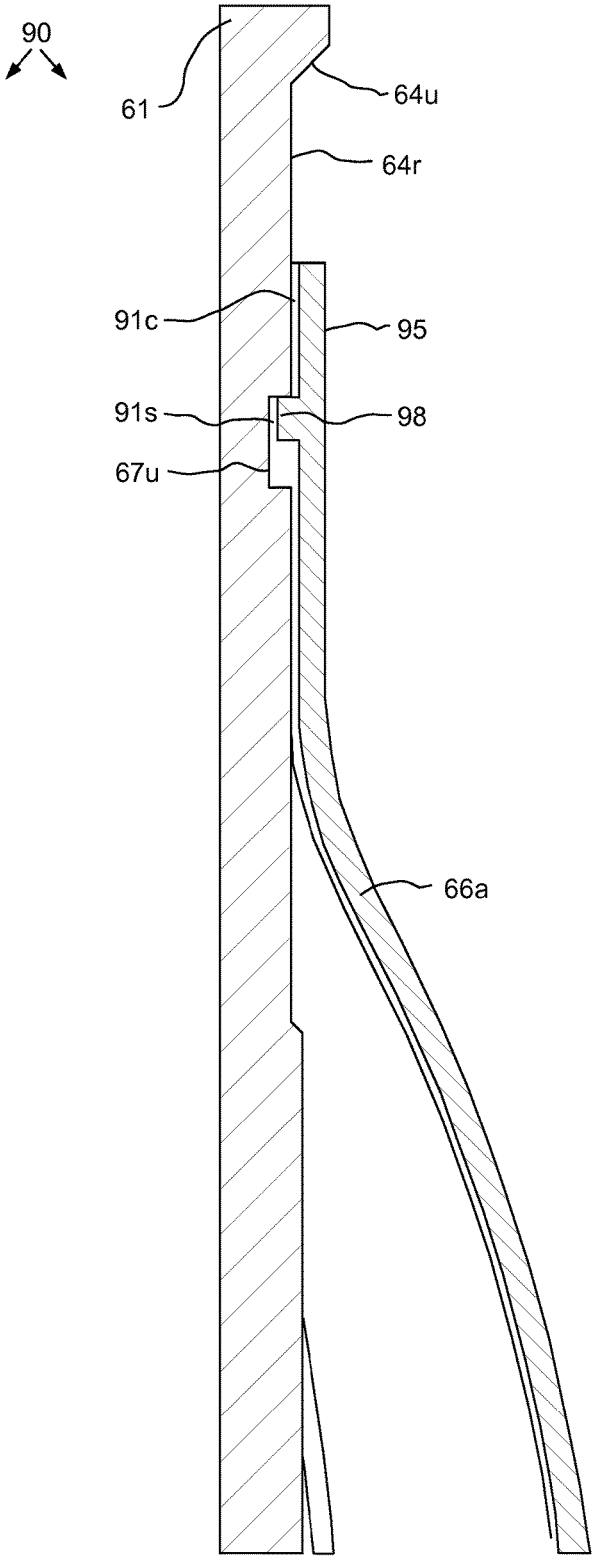

FIGS. 5A and 5B illustrate a second alternative centralizer sub 90, according to another embodiment of this disclosure. A plurality of the second alternative centralizer subs 90 may be assembled with the inner casing string 15 instead of the centralizer subs 60*a-f*. The second alternative centralizer sub 90 may include the body 61, a centralizer 92, and one or more slip joints, such as an upper slip joint 93 and a lower slip joint (not shown).

The centralizer 92 may include an upper collar 95, a lower collar (not shown), and a plurality of bow springs 66*a-h* connecting the collars. The centralizer 92 may longitudinally extend when moving from the expanded position to the compressed position and longitudinally contract when moving from the compressed position to the expanded position. Each slip joint 93 may include the respective groove 67*u,b* and a protrusion, such as a shoulder 98. The slip joints 93 may longitudinally link the centralizer 92 to the body 61 while accommodating extension and contraction of the centralizer due to the expansion and compression of the bow springs 66*a-h*. Each groove 67*u,b* may be formed in and around the body recessed portion 64*r* adjacent to a respective body shoulder 64*u,b* for receiving the respective joint shoulder 98. Each joint shoulder 98 may be attached to the respective collar 95. Each shoulder 98 may be made from any of the lug materials discussed above. Each shoulder 98 may extend around an inner surface of the respective collar 95 and be split at the collar seam. Each shoulder 98 may have a rectangular cross section and have an inner portion protruding inwardly from the respective collar 95 into the respective groove 67*u,b*.

The centralizer 92 may be of one-piece construction and may be made from any of the materials discussed above for the centralizer 62. The centralizer 92 may be formed starting with sheet metal. The sheet may be cut to form bow strips, such as by a CNC machine tool having a laser, plasma, or water jet cutter. A shoulder strip may then be formed along an inner surface of each collar portion, such as by weld forming. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. A protective coating may then be applied to the split cylindrical assembly to resist corrosion in the wellbore 24. The split cylindrical assembly may then be slid over the body 61 into the recessed portion 64*r*. Seams formed between respective ends of collar portions of the assembly may then be joined, such as by seam welding. The seam welding may be accomplished by electric resistance welding. The seam weld may be a butt joint. A protective coating may then be applied to the seam weld.

Alternatively, each shoulder 98 may have a semi-circular cross section instead of rectangular. Alternatively, the shoulder strips may be pre-formed and welded along inner surfaces of the collar portions instead of weld forming the shoulder strips. Alternatively, each shoulder 98 may be integrally formed with the respective collar 95. Alternatively, the sheet may be formed into a split cylindrical shape before cutting the bow strips. Alternatively, the split cylindrical shape may be plastically expanded before cutting the bow strips.

The collars 95 may have an inner diameter slightly greater than an outer diameter of the recessed portion 64*r*, thereby forming a clearance 91*c* between the centralizer 92 and the body 61. The collar clearance 91*c* may accommodate rotation 49 of the body 61 relative to the centralizer 92. Each joint shoulder 98 may have an inner diameter slightly greater than a diameter of the respective groove 67*u,b* and less than a diameter of the recessed portion 64*r*, thereby forming a clearance 91*s* between the joint shoulders and the body 61 and trapping the shoulders within the respective grooves. The shoulder clearance 91*s* may be sufficient to accommodate rotation 49 of the body 61 relative to the joint shoulders 98. A length of each groove 67*u,b* may correspond to a stroke length of the centralizer 92. The groove length may be greater than or equal to a sum of a length of the shoulders 98 plus the stroke length, thereby accommodating expansion and contraction of the centralizer 92.

Upon encountering a restriction during lowering of the inner casing string 15, the centralizer 92 may be stopped by the restriction while the body 61 continues downward movement until engagement of an upper face of the lower groove 67*b* with an upper face of the lower joint shoulder. The engagement may then pull the centralizer 92 through the restriction as the bow springs 66*a-h* compress. The resultant extension of the centralizer 92 may be accommodated by movement of the upper shoulder 98 along the upper groove 67*u* until the bow springs 66*a-h* have compressed enough to pass through the restriction.

Inclusion of the upper slip joint 93 may provide a similar pulling capability if it becomes necessary to raise the inner casing string 15 through a restriction and/or reciprocate the inner casing string. If the need to raise and/or reciprocate the inner casing string 15 is not envisioned, the upper slip joint 93 may be omitted. If the upper slip joint 93 is omitted, then the lower groove 67*b* may also be shortened as it will no longer need to accommodate extension and contraction of the centralizer 92 since the upper collar 95*u* will be free to move relative to the body 61.

Figure 6:
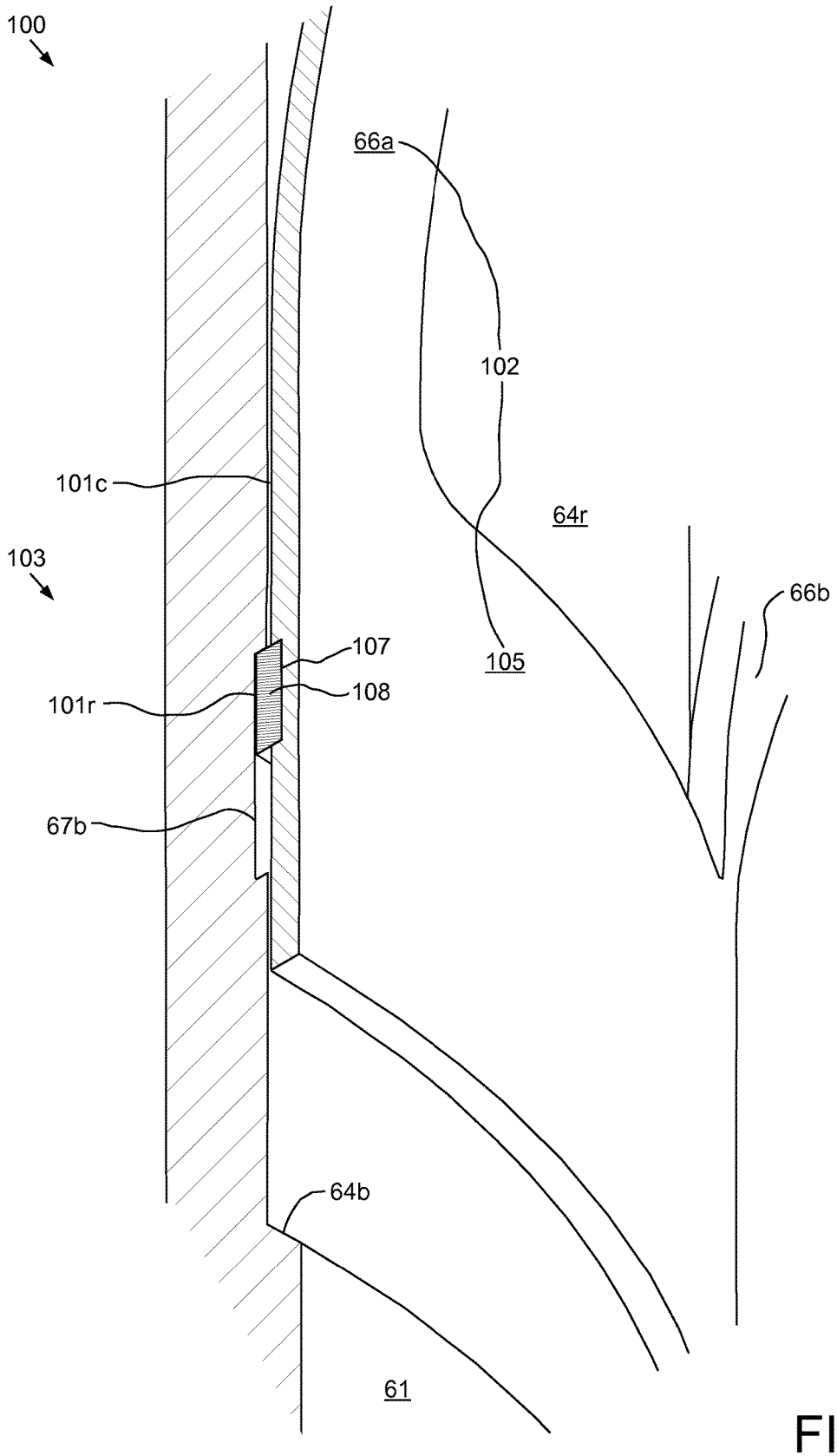
FIG. 6 illustrates a third alternative centralizer sub, according to another embodiment of this disclosure.

FIG. 6 illustrates a third alternative centralizer sub 100, according to another embodiment of this disclosure. A plurality of the third alternative centralizer subs 100 may be assembled with the inner casing string 15 instead of the centralizer subs 60*a-f*. The third alternative centralizer sub 100 may include the body 61, a centralizer 102, and one or more slip joints, such as an upper slip joint (not shown) and a lower slip joint 103.

The centralizer 102 may include an upper collar (not shown), a lower collar 105, and a plurality of bow springs 66*a-h* connecting the collars. The centralizer 102 may longitudinally extend when moving from the expanded position to the compressed position and longitudinally contract when moving from the compressed position to the expanded position. Each slip joint 103 may include the respective body groove 67*u,b*, a respective collar groove 107, and a protrusion, such as a snap ring 108. The slip joints 103 may longitudinally link the centralizer 102 to the body 61 while accommodating extension and contraction of the centralizer due to the expansion and compression of the bow springs 66*a-h*. Each groove 67*u,b* may be formed in and around the body recessed portion 64*r* adjacent to a respective body shoulder 64*u,b* for receiving the respective snap ring 108.

Each snap ring 108 may be made from any of the lug materials discussed above. Each snap ring 108 may be sized to fit snugly in the collar groove 107, thereby longitudinally connecting the snap rings 108 to the centralizer 62. Each snap ring 108 may have a rectangular cross section and have an inner portion protruding inwardly from the respective collar 105 into the respective groove 67*u,b*.

The centralizer 102 may be of one-piece construction and may be made from any of the materials discussed above for the centralizer 62. The centralizer 102 may be formed starting with sheet metal. The sheet may be cut to form bow strips and the collar grooves 107, such as by a CNC machine tool having a laser, plasma, or water jet cutter. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. The snap rings 108 may then be compressed, located adjacent to the collar grooves 107, and released, thereby expanding into the collar grooves. A protective coating may then be applied to the split cylindrical assembly to resist corrosion in the wellbore 24. The split cylindrical assembly may then be slid over the body 61 into the recessed portion 64*r*. Seams formed between respective ends of collar portions of the assembly may then be joined, such as by seam welding. The seam welding may be accomplished by electric resistance welding. The seam weld may be a butt joint. A protective coating may then be applied to the seam weld.

Alternatively, each snap ring 108 may have a circular cross section instead of rectangular. Alternatively, joint strips may be fit into the collar grooves 107, such as by interference fit, before forming the sheet into the split cylindrical shape instead of using snap rings 108. Alternatively, the sheet may be formed into a split cylindrical shape before cutting the bow strips. Alternatively, the split cylindrical shape may be plastically expanded before cutting the bow strips.

The collars 105 may have an inner diameter slightly greater than an outer diameter of the recessed portion 64*r*, thereby forming a clearance 101*c* between the centralizer 102 and the body 61. The collar clearance 101*c* may accommodate rotation 49 of the body 61 relative to the centralizer 102. Each snap ring 108 may have an inner diameter slightly greater than a diameter of the respective groove 67*u,b* and less than a diameter of the recessed portion 64*r*, thereby forming a clearance 101*r* between the snap rings and the body 61 and trapping the snap rings within the respective grooves. The snap ring clearance 101*r* may be less than the collar clearance 101*c* but still sufficient to accommodate rotation 49 of the body 61 relative to the joint shoulders 98. A length of each groove 67*u,b* may correspond to a stroke length of the centralizer 102. The groove length may be greater than or equal to a sum of a length of the snap rings 108 plus the stroke length, thereby accommodating expansion and contraction of the centralizer 102.

Alternatively, the snap ring clearance 101*r* may be greater than or equal to the collar clearance 101*c* while maintaining entrapment of the snap rings 108 within the respective grooves 67*u,b*.

Upon encountering a restriction during lowering of the inner casing string 15, the centralizer 102 may be stopped by the restriction while the body 61 continues downward movement until engagement of an upper face of the lower groove 67*b* with an upper face of the lower snap ring 108. The engagement may then pull the centralizer 102 through the restriction as the bow springs 66*a-h* compress. The resultant extension of the centralizer 102 may be accommodated by movement of the upper snap ring along the upper groove 67*u* until the bow springs 66*a-h* have compressed enough to pass through the restriction.

Inclusion of the upper slip joint may provide a similar pulling capability if it becomes necessary to raise the inner casing string 15 through a restriction and/or reciprocate the inner casing string. If the need to raise and/or reciprocate the inner casing string 15 is not envisioned, the upper slip joint may be omitted. If the upper slip joint is omitted, then the lower groove 67*b* may also be shortened as it will no longer need to accommodate extension and contraction of the centralizer 102 since the upper collar will be free to move relative to the body 61.

Figure 7A:
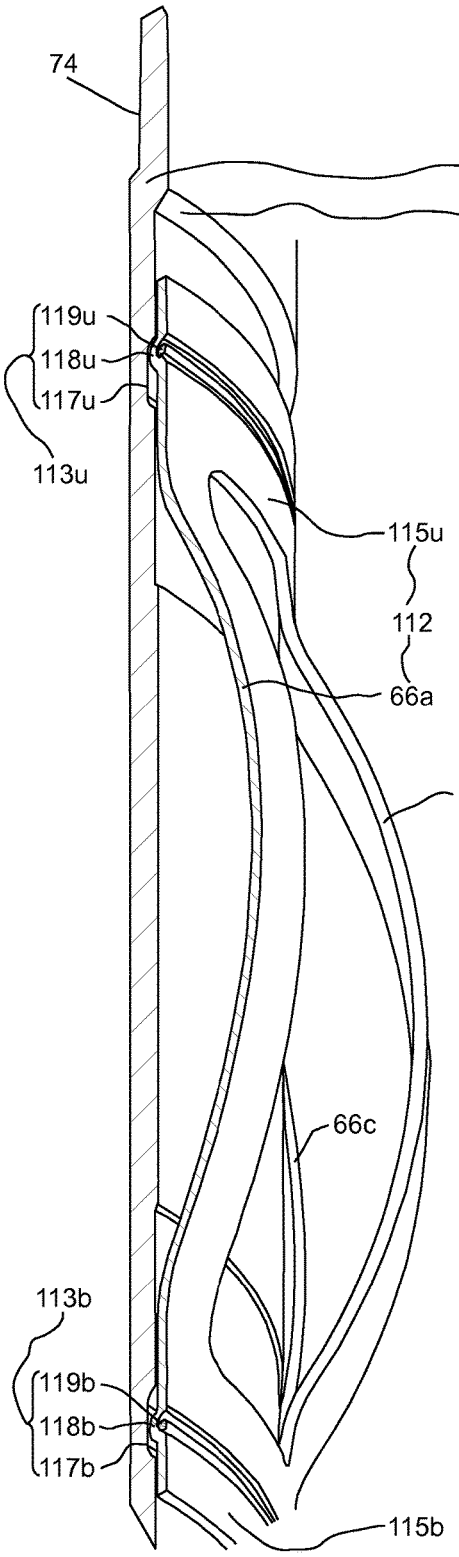
FIGS. 7A and 7B illustrates a fourth alternative centralizer sub, according to another embodiment of this disclosure.
Figure 7B:
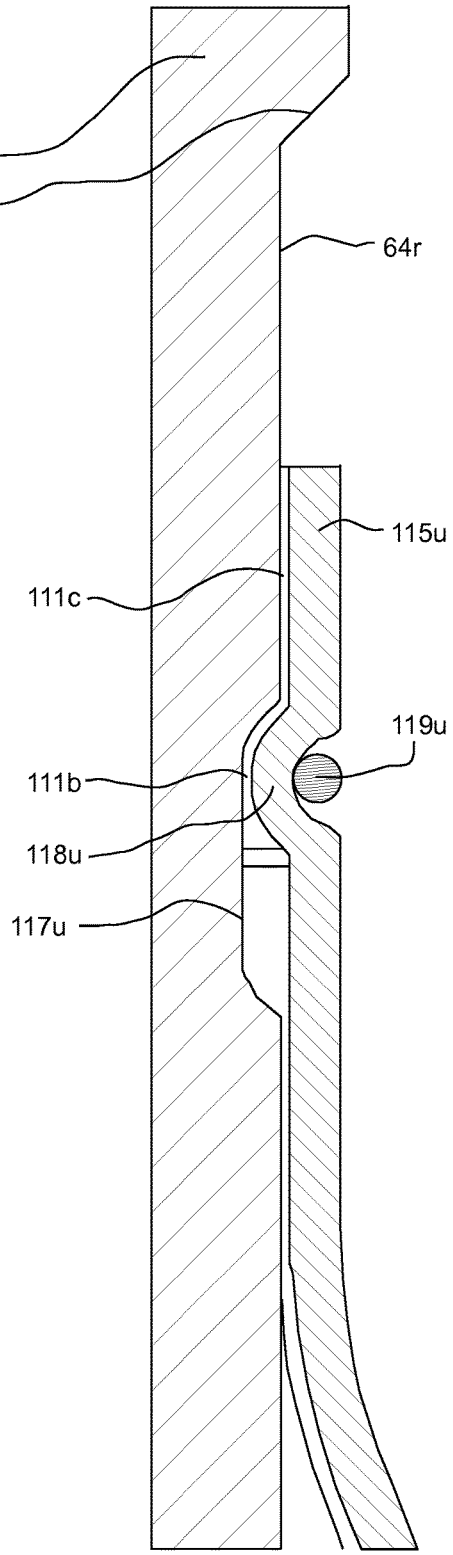

FIGS. 7A and 7B illustrates a fourth alternative centralizer sub 110, according to another embodiment of this disclosure. A plurality of the fourth alternative centralizer subs 110 may be assembled with the inner casing string 15 instead of the centralizer subs 60*a-f*. The fourth alternative centralizer sub 110 may include the body 61, a centralizer 112, and one or more slip joints, such as an upper slip joint 113*u* and a lower slip joint 113*b*.

The centralizer 112 may include an upper collar 115*u*, a lower collar 115*b*, and a plurality of bow springs 66*a-h* connecting the collars. The centralizer 112 may longitudinally extend when moving from the expanded position to the compressed position and longitudinally contract when moving from the compressed position to the expanded position. Each slip joint 113*u,b* may include a respective groove 117*u,b*, a protrusion, such as a bead 118*u,b*, and a bead retainer, such as a wire 119*u,b*. The slip joints 113*u,b* may longitudinally link the centralizer 112 to the body 61 while accommodating extension and contraction of the centralizer due to the expansion and compression of the bow springs 66*a-h*. Each groove 117*u,b* may be formed in and around the body recessed portion 64*r* adjacent to a respective body shoulder 64*u,b* for receiving the respective bead 118*u,b*. Each bead 118*u,b* may be formed integrally with the respective collar 115*u,b*. Each wire 119*u,b* may be made from a metal or alloy, such as spring steel. Each bead 118*u,b* may extend around an inner surface of the respective collar 115*u,b* and be split at the collar seam. Each bead 118 may have a semi-annular cross section and have an inner portion protruding inwardly from the respective collar 115*u,b* into the respective groove 117*u,b*. Each groove 117*u,b* may have a correspondingly tapered upper and lower face for mating with the respective bead 118*u,b*.

The centralizer 112 may be of one-piece construction and may be made from any of the materials discussed above for the centralizer 62. The centralizer 112 may be formed starting with sheet metal. The sheet may be cut to form bow strips, such as by a CNC machine tool having a laser, plasma, or water jet cutter. A bead strip may then be formed along an inner surface of each collar portion, such as by roll forming. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. A protective coating may then be applied to the split cylindrical assembly to resist corrosion in the wellbore 24. The split cylindrical assembly may then be slid over the body 61 into the recessed portion 64*r*. Seams formed between respective ends of collar portions of the assembly may then be joined, such as by seam welding. The seam welding may be accomplished by electric resistance welding. The seam weld may be a butt joint. Each wire 119*u,b* may then be wrapped into a groove formed in an outer surface of the respective bead 118*u,b*. Ends of each wire 119*u,b* may or may not be joined, such as by welding or soldering. A protective coating may then be applied to the seam weld and the wires 119*u,b*.

Alternatively, each bead 118*u,b* may have a semi-box shaped cross section instead of annular. Alternatively, the sheet may be formed into a split cylindrical shape before cutting the bow strips. Alternatively, the split cylindrical shape may be plastically expanded before cutting the bow strips.

The collars 115 may have an inner diameter slightly greater than an outer diameter of the recessed portion 64*r*, thereby forming a clearance 111*c* between the centralizer 112 and the body 61. The collar clearance 111*c* may accommodate rotation 49 of the body 61 relative to the centralizer 112. Each bead 118*u,b* may have an inner diameter slightly greater than a diameter of the respective groove 117*u,b* and less than a diameter of the recessed portion 64*r*, thereby forming a clearance 111*b* between the bead and the body 61 and trapping the beads within the respective grooves. The bead clearance 111*b* may be sufficient to accommodate rotation 49 of the body 61 relative to the beads 118*u,b*. A length of each groove 117*u,b* may correspond to a stroke length of the centralizer 112. The groove length may be greater than or equal to a sum of a length of the beads 118*u,b* plus the stroke length, thereby accommodating expansion and contraction of the centralizer 112.

Upon encountering a restriction during lowering of the inner casing string 15, the centralizer 112 may be stopped by the restriction while the body 61 continues downward movement until engagement of an upper face of the lower groove 117*b* with an upper face of the lower bead 118*b*. The engagement may then pull the centralizer 112 through the restriction as the bow springs 66*a-h* compress. The resultant extension of the centralizer 112 may be accommodated by movement of the upper bead 118*u* along the upper groove 117*u* until the bow springs 66*a-h* have compressed enough to pass through the restriction.

Inclusion of the upper slip joint 113*u* may provide a similar pulling capability if it becomes necessary to raise the inner casing string 15 through a restriction and/or reciprocate the inner casing string. If the need to raise and/or reciprocate the inner casing string 15 is not envisioned, the upper slip joint 113*u* may be omitted. If the upper slip joint 113*u* is omitted, then the lower groove 117*b* may also be shortened as it will no longer need to accommodate extension and contraction of the centralizer 112 since the upper collar 115*u* will be free to move relative to the body 61.

Figure 8:
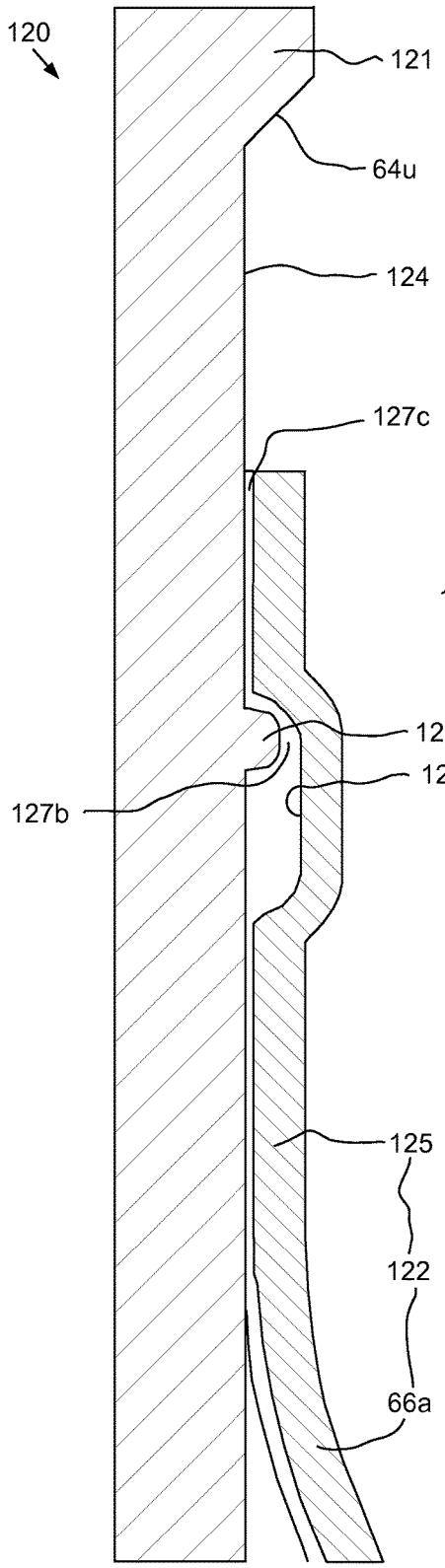
FIG. 8 illustrates a fifth alternative centralizer sub, according to another embodiment of this disclosure.

FIG. 8 illustrates a fifth alternative centralizer sub 120, according to another embodiment of this disclosure. A plurality of the fifth alternative centralizer subs 120 may be assembled with the inner casing string 15 instead of the centralizer subs 60*a-f*. The fifth alternative centralizer sub 120 may include a body 121, a centralizer 122, and one or more slip joints, such as an upper slip joint 123 and a lower slip joint (not shown).

The body 121 may be tubular and have threaded couplings, such as a pin or box, formed at longitudinal ends thereof for connection to joints 15*j* of the inner casing string 15. The body 121 may have a recessed portion 124 formed in an outer surface thereof for receiving the centralizer 122. The recessed portion 124 may extend along the body outer surface between upper 64*u* and lower 64*b* shoulders formed in the body outer surface. A length of the recessed portion 124 may be greater than a length of the centralizer 122 in a compressed position (not shown). The body 121 may be of one-piece construction and may be made from any of the materials discussed above for the body 121. An inner diameter of a bore of the body 121 may be greater than or equal to a drift diameter of the casing joints 15*j*.

The centralizer 122 may include an upper collar 125, a lower collar (not shown), and a plurality of bow springs 66*a-h* connecting the collars. The centralizer 122 may longitudinally extend when moving from the expanded position to the compressed position and longitudinally contract when moving from the compressed position to the expanded position. Each slip joint 123 may include a protrusion, such as a bead 128, and a respective groove 129. The slip joints 123 may longitudinally link the centralizer 122 to the body 121 while accommodating extension and contraction of the centralizer due to the expansion and compression of the bow springs 66*a-h*. Each bead 128 may be formed in and around the body recessed portion 124 adjacent to a respective body shoulder 64*u,b* for receiving the respective groove 129. Each groove 129 may be formed integrally with the respective collar 125. Each bead 118 may have a semi-circular cross section and protrude outwardly from the recessed portion 124 into the respective groove 129. Each groove 129 may have a correspondingly tapered upper and lower face for mating with the respective bead 128.

The bead 128 may be formed in an outer surface of the body 121 when machining the recessed portion 124 therein. The centralizer 122 may be of one-piece construction and may be made from any of the materials discussed above for the centralizer 62. The centralizer 122 may be formed starting with sheet metal. The sheet may be cut to form bow strips, such as by a CNC machine tool having a laser, plasma, or water jet cutter. A groove strip may then be formed along an inner surface of each collar portion, such as by roll forming. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. A protective coating may then be applied to the split cylindrical assembly to resist corrosion in the wellbore 24. The split cylindrical assembly may then be slid over the body 61 into the recessed portion 124. Seams formed between respective ends of collar portions of the assembly may then be joined, such as by seam welding. The seam welding may be accomplished by electric resistance welding. The seam weld may be a butt joint. A protective coating may then be applied to the seam weld.

Alternatively, each bead 128 may have a rectangular cross section instead of circular. Alternatively, the sheet may be formed into a split cylindrical shape before cutting the bow strips. Alternatively, the split cylindrical shape may be plastically expanded before cutting the bow strips.

The collars 125 may have an inner diameter slightly greater than an outer diameter of the recessed portion 124, thereby forming a clearance 127*c* between the centralizer 122 and the body 121. The collar clearance 127*c* may accommodate rotation 49 of the body 121 relative to the centralizer 122. Each bead 128 may have an outer diameter slightly less than an inner diameter of the respective groove 129 and greater than an inner diameter of the respective collar 125, thereby forming a clearance 127*b* between the bead and the respective collar and trapping the beads within the respective grooves. The bead clearance 127*b* may be sufficient to accommodate rotation 49 of the body 121 relative to the grooves 129. A length of each groove 129 may correspond to a stroke length of the centralizer 122. The groove length may be greater than or equal to a sum of a length of the beads 128 plus the stroke length, thereby accommodating expansion and contraction of the centralizer 122.

Upon encountering a restriction during lowering of the inner casing string 15, the centralizer 122 may be stopped by the restriction while the body 121 continues downward movement until engagement of an upper face of the lower groove with an upper face of the lower bead. The engagement may then pull the centralizer 122 through the restriction as the bow springs 66*a-h* compress. The resultant extension of the centralizer 122 may be accommodated by movement of the upper bead 128 along the upper groove 129 until the bow springs 66*a-h* have compressed enough to pass through the restriction.

Inclusion of the upper slip joint 123 may provide a similar pulling capability if it becomes necessary to raise the inner casing string 15 through a restriction and/or reciprocate the inner casing string. If the need to raise and/or reciprocate the inner casing string 15 is not envisioned, the upper slip joint 123 may be omitted. If the upper slip joint 123 is omitted, then the lower groove may also be shortened as it will no longer need to accommodate extension and contraction of the centralizer 122 since the upper collar 125 will be free to move relative to the body 121.

In another embodiment, a plurality of modified centralizer subs (not shown) may be assembled with the inner casing string 15 instead of the centralizer subs 60*a-f*. Each modified alternative centralizer sub may include a body, a centralizer, and upper and lower slip joints. The upper slip joint may be any one of the upper slip joints 63*u*, 83*u*, 93, 113*u*, 123 discussed above and the lower slip joint may be a different one of any of the lower slip joints 63*b*, 83*b*, 103 discussed above. For example, each modified alternative centralizer sub may include the upper slip joint 83*u* and the lower slip joint 63*b* or vice versa.

Figure 9:
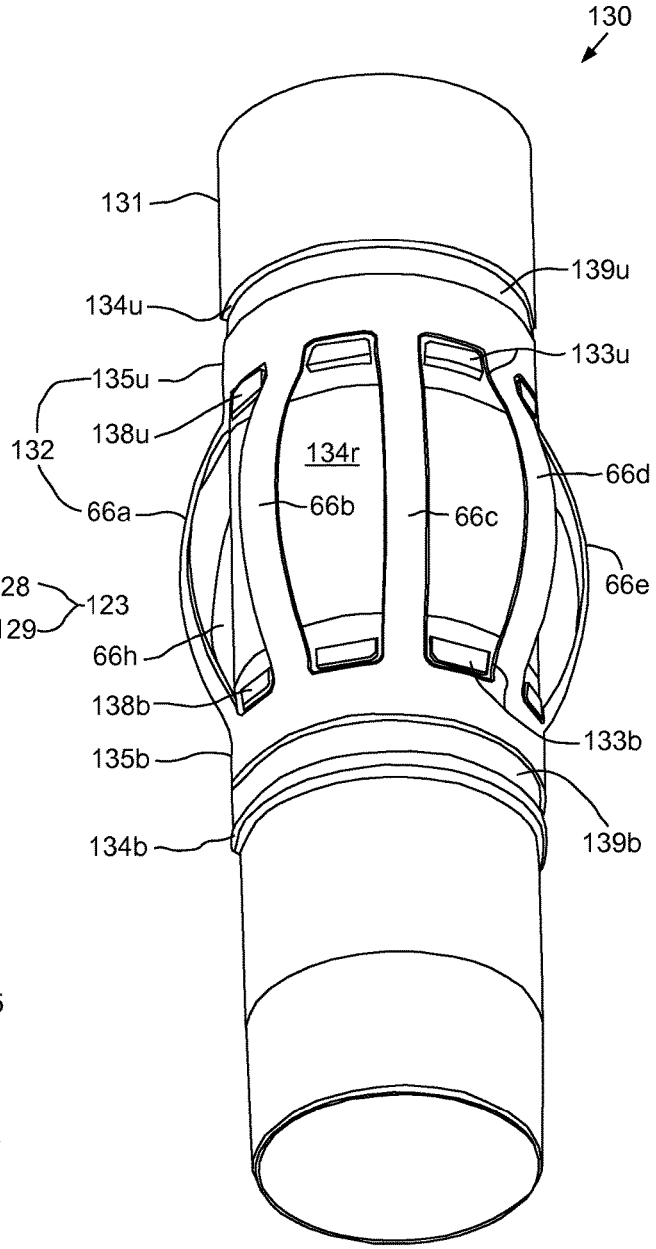
FIG. 9 illustrates a sixth alternative centralizer sub, according to another embodiment of this disclosure.

FIG. 9 illustrates a sixth alternative centralizer sub 130, according to another embodiment of this disclosure. A plurality of the sixth alternative centralizer subs 130 may be assembled with the inner casing string 15 instead of the centralizer subs 60*a-f*. The sixth alternative centralizer subs 130 may include a body 131, a centralizer 132, and one or more torsional arrestors, such as an upper arrestor 133*u* and a lower arrestor 133*b*.

The body 131 may be tubular and have threaded couplings, such as a pin or box, formed at longitudinal ends thereof for connection to joints 15*j* of the inner casing string 15. The body 131 may have a receptacle portion 134*r* formed in an outer surface thereof for receiving the centralizer 132. The receptacle portion 134*r* may extend along the body outer surface between upper 134*u* and lower 134*b* shoulders formed in the body outer surface. A length of the receptacle portion 134*r* may correspond to a length of the centralizer 132 in a compressed position (not shown). The body 131 may be of one-piece construction and may be made from any of the materials discussed above for the body 61. An inner diameter of a bore of the body 131 may be greater than or equal to a drift diameter of the casing joints 15*j*.

The centralizer 132 may include an upper collar 135*u*, a lower collar 135*b*, and a plurality of bow springs 66*a-h* connecting the collars. A groove 139*u,b* for each collar 135*u,b* may be formed in the receptacle portion 134*r* adjacent to the respective shoulder 134*u,b*. The centralizer 132 may longitudinally extend when moving from the expanded position to the compressed position and longitudinally contract when moving from the compressed position to the expanded position. Each torsional arrestor 133*u,b* may include a respective set of one or more protrusions, such as keys 138*u,b*, and respective spaces between the bow springs 66*a-h*. The torsional arrestors 133*u,b* may torsionally connect the centralizer 132 to the body 131 while accommodating extension and contraction of the centralizer due to the expansion and compression of the bow springs 66*a-h*. Each key 138*u,b* may protrude outwardly from the respective groove 139*u,b* and into a respective space between the bow springs 66*a-h*.

Each of the keys 138*u,b* in the respective set may be aligned and spaced around the body 131 and the bow springs 66*a-h* may straddle the keys 138*u,b*. Each set of keys 138*u,b* may be located adjacent to the respective collar 135*u,b* so that the torsional arrestors 133*u,b* may also serve the function of the slip joints. The number of keys 138*u,b* in each set may be related to the number of bow springs 66*a-h*, such as the number of keys equaling the number of bow springs minus one. Each key 138*u,b* may be an arcuate segment and may have a width corresponding to the spacing between each bow spring 66*a-h* (shown).

The keys 138*u,b* may be formed in an outer surface of the body 131 when machining the respective grooves 139*u,b* therein. The centralizer 132 may be of one-piece construction and may be made from any of the materials discussed above for the centralizer 62. The centralizer 132 may be formed starting with sheet metal. The sheet may be cut to form bow strips, such as by a CNC machine tool having a laser, plasma, or water jet cutter. The cut sheet may then be formed into a split cylindrical shape, such as by hot or cold forming. The hot or cold forming may be pressing or rolling. The bow strips may then be plastically expanded into the bow springs 66*a-h*. The bow strips may be plastically expanded with an inflatable packer. A protective coating may then be applied to the split cylindrical assembly to resist corrosion in the wellbore 24. The split cylindrical assembly may then be slid over the body 131 into the receptacle 134*r*. Seams formed between respective ends of collar portions of the assembly may then be joined, such as by seam welding. The seam welding may be accomplished by electric resistance welding. The seam weld may be a butt joint. A protective coating may then be applied to the seam weld.

Alternatively, the sheet may be formed into a split cylindrical shape before cutting the bow strips. Alternatively, the split cylindrical shape may be plastically expanded before cutting the bow strips.

The collars 135*u,b* may have an inner diameter slightly greater than an outer diameter of the respective groove

139*u,b*, thereby forming a clearance between the centralizer 132 and the body 131. The collar clearance may accommodate sliding of the body 131 relative to the centralizer 132. An effective outer diameter of each set of keys 138*u,b* may be equal to or slightly greater than an outer diameter of the respective collar 135*u,b*, thereby forming torsional stops between the centralizer 132 and the body 131. A length of a portion of each groove 139*u,b* from the respective shoulder 134*u,b* to the respective set of keys 138*u,b* may correspond to a stroke length of the centralizer 132, thereby accommodating expansion and contraction of the centralizer 122.

Upon encountering a restriction during lowering of the inner casing string 15, the centralizer 132 may be stopped by the restriction while the body 131 continues downward movement until engagement of the lower collar 135*b* with the lower set of keys 138*b*. The engagement may then pull the centralizer 132 through the restriction as the bow springs 66*a-h* compress. The resultant extension of the centralizer 132 may be accommodated by movement of the upper collar 135*u* along the upper groove 139*u* until the bow springs 66*a-h* have compressed enough to pass through the restriction.

Inclusion of the upper arrestor 133*u* may provide a similar pulling capability if it becomes necessary to raise the inner casing string 15 through a restriction and/or reciprocate the inner casing string. If the need to raise and/or reciprocate the inner casing string 15 is not envisioned, the upper arrestor 133*u* may be omitted. If the upper arrestor 133*u* is omitted, then the lower groove 139*b* may also be shortened as it will no longer need to accommodate extension and contraction of the centralizer 132 since the upper collar 135*u* will be free to move relative to the body 131.

While the foregoing is directed to embodiments of the present disclosure, other and further embodiments of the disclosure may be devised without departing from the basic scope thereof, and the scope of the present invention is determined by the claims that follow.

The invention claimed is:

1. A centralizer sub for cementing a tubular string in a wellbore, comprising:

a tubular body;

a centralizer disposed along an outer surface of the body and having a pair of collars and a plurality of bow springs connecting the collars; and one or two joints longitudinally linking the centralizer to the body, each joint having:

a groove formed in and around the body outer surface, and a plurality of protrusions formed integrally with or mounted to one of the collars and extending into the groove; and wherein:

the protrusions are lugs received in openings formed through the one collar;

the lugs are each arcuate segments, lugs each have an outer portion received in a respective opening and an inner portion engaged with an inner surface of the one collar and extending into the groove, each outer portion comprises a plurality of discrete fasteners, and the plurality of discrete fasteners overlap a longitudinal end of the inner portion.

2. A centralizer sub for cementing a tubular string in a wellbore, comprising:

a tubular body;

a centralizer disposed along an outer surface of the body and having a pair of collars and a plurality of bow springs connecting the collars; and one or two joints longitudinally linking the centralizer to the body, each joint having:

a groove formed in and around the body outer surface, the groove defined by an inner shoulder at a first end and an outer shoulder at a second end of the groove; and a plurality of lugs having an outer portion of each lug constructed and arranged to be held within a corresponding opening formed in one of the collars, and an inner portion extending into the groove, wherein lengthening and shortening of the centralizer is determined by movement between the inner portion of the lug in the groove and wherein there is no corresponding movement between the outer portion of the lug and the openings.

3. The centralizer of claim 2, wherein the centralizer includes an expanded position in which the centralizer is shortened due to movement of the inner portion of the plurality of lugs of at least one joint towards the inner shoulder of a corresponding groove.

4. The centralizer of claim 3, wherein the centralizer is biased in the expanded position.

5. The centralizer of claim 2, wherein the centralizer includes a compressed position in which the centralizer is lengthened due to movement of the inner portion of the plurality of lugs of at least one joint towards the outer shoulder of a corresponding groove.

6. The centralizer of claim 2, wherein a surface of the outer portion is arcuate in shape to correspond with a curvature defined by the shape of the outer surface of the collar.

7. The centralizer sub of claim 2, wherein the lugs are fusion welded, interference fit, or bonded to the one collar.

8. The centralizer sub of claim 2, wherein:

the body is one-piece construction, and the centralizer is one-piece construction.

9. The centralizer sub of claim 2, wherein the bow springs are identical.

10. The centralizer sub of claim 2, wherein the lugs are each studs.

11. The centralizer sub of claim 2, wherein each outer portion comprises a plurality of discrete fasteners.

12. A method of using a centralizer in a wellbore comprising:

providing a centralizer having:

a tubular body;

a centralizer disposed along an outer surface of the body and having a pair of collars and a plurality of bow springs connecting the collars; and one or two joints longitudinally linking the centralizer to the body, each joint having:

a groove formed in and around the body outer surface, the groove defined by an inner shoulder at one end and an inner shoulder at an opposite end of the groove; and a plurality of lugs having an outer portion of each lug constructed and arranged to be held within a corresponding opening formed in one of the collars, and an inner portion extending into the groove;

running the centralizer into a wellbore on a string of tubulars;

encountering a restriction in the wellbore, thereby causing the centralizer to shift from an expanded to a shorter, compressed position whereby;

shortening of the centralizer is determined by movement between the inner portion of the lug and the groove and wherein there is no corresponding movement between the outer portion of the lug and the openings.

13. The method of claim 12, further including:

clearing the restriction, thereby causing the centralizer to shift from the compressed position to a longer, expanded position.

* * * * *